US007604572B2

(12) United States Patent
Stanford

(10) Patent No.: US 7,604,572 B2
(45) Date of Patent: Oct. 20, 2009

(54) APPARATUS AND METHOD FOR WHEELCHAIR AEROBIC STATIONARY EXERCISE

(75) Inventor: Christopher Stephen Reece Stanford, 865 Latteridge Dr., Austin, TX (US) 78748

(73) Assignee: Christopher Stephen Reece Stanford, Austin, TX (US)

( * ) Notice: Subject to any disclaimer, the term of this patent is extended or adjusted under 35 U.S.C. 154(b) by 0 days.

(21) Appl. No.: 11/625,783

(22) Filed: Jan. 22, 2007

(65) Prior Publication Data

US 2007/0173392 A1 Jul. 26, 2007

Related U.S. Application Data

(60) Provisional application No. 60/761,186, filed on Jan. 23, 2006.

(51) Int. Cl.
*A63B 22/00* (2006.01)
*A63B 71/00* (2006.01)
*A63B 69/16* (2006.01)

(52) U.S. Cl. ..... 482/51; 482/61; 482/904

(58) Field of Classification Search ..... 482/60–62, 482/904, 51, 54, 57, 78; 434/255; *A63B 22/00, A63B 69/16, 71/00*

See application file for complete search history.

(56) References Cited

U.S. PATENT DOCUMENTS

| | | | | | |
|---|---|---|---|---|---|
| 3,824,993 | A * | 7/1974 | Grant | 601/36 |
| 4,233,844 | A * | 11/1980 | Dreisinger et al. | 73/379.06 |
| 4,365,801 | A * | 12/1982 | Medina et al. | 482/34 |
| 4,700,962 | A * | 10/1987 | Salmon | 280/220 |
| 4,911,425 | A * | 3/1990 | Kynast et al. | 482/54 |
| 4,966,362 | A | 10/1990 | Ramaekers | |
| 5,649,883 | A | 7/1997 | Mayes et al. | |
| 5,704,876 | A | 1/1998 | Baatz | |
| 6,699,160 | B1 * | 3/2004 | Pan et al. | 482/54 |
| 2003/0203792 | A1 | 10/2003 | Pestes | |

* cited by examiner

*Primary Examiner*—Loan H Thanh
*Assistant Examiner*—Oren Ginsberg

(57) ABSTRACT

An improved wheelchair trainer with independent flywheel resistance for each wheelchair rear wheel. A lever-operated cam raises the wheelchair rear axle by pushing an inclined block against the axle and forces the rear wheels against wheel engagement means. As one or both rear wheels are turned, each wheel engagement means turns a flywheel in proportion to the speed of the wheel. Force and work may be calculated from the measured rotational speed of the flywheels. A hand-cycle attachment may drive the flywheel resistance.

12 Claims, 18 Drawing Sheets

FIG. 1 - PRIOR ART 284b
211b
215
212b
212b
217
212a
212a
218
284a
211a 100
120a
120b
112
262a
262b
270a
270b
272a
272b
284a
284b
282a
282b
210
221
200

APPARATUS AND METHOD FOR WHEELCHAIR AEROBIC STATIONARY EXERCISE

RELATED APPLICATIONS

This application is related to U.S. Provisional Patent Application No. 60/761,186 filed Jan. 23, 2006, and claims the filing date of that application.

BACKGROUND

1. Field of Invention

This invention relates to a wheelchair exercise trainer.

2. Prior Art

A typical prior art trainer provides a pair of elongated rollers set in a frame. A ramp is typically provided so that the chair may be guided up the ramp to a platform with the recessed rollers. FIG. 1 is a perspective view of a typical prior art trainer.

Disadvantages of the prior art device include its large footprint, the expense of the device, and the inability to provide independent wheelchair wheel operation.

Another disadvantage of prior art devices is that they are typically designed for a forward direction only, so that the devices work when the wheelchair wheels are driven in a forward direction, but may not work well when the wheelchair wheels are driven in a reverse direction. Although these forward devices may improve torso and arm strength, they do not provide a balanced exercise regimen to strengthen the back muscles and to lengthen the torso muscles. If the predominant movements are in a forward direction, the back muscles may not be appropriately strengthened, and the torso muscles will have a tendency to constrict. A complimentary backward direction is desirable in order to lengthen the torso muscles.

There is a need for a smaller and less expensive device. There is a need for a device which permits independent wheel operation in both the forward and reverse directions.

U.S. Pat. No. 4,966,362 describes a shallow rectangular frame which supports a pair of free-running elongated rollers parallel to each other and spaced suitably to cradle the main wheels of a conventional wheelchair. A gentle ramp ahead of the rollers enables a wheelchair occupant to drive the wheelchair backwards up the ramp and roll the wheels into the roller cradle. A transverse backstop guards against overrunning the cradle. With the main wheels of the wheelchair in the roller cradle, the front wheels of the chair are supported by the ramp. An adjustable brake at the front roller provides for variable exercising effort and also brakes or locks the roller so that the chair may be easily driven out of the roller cradle and down the ramp.

U.S. Pat. No. 6,645,127 describes an exercise apparatus for a wheelchair which has a raised platform with an upper surface which will support a wheelchair. Front and rear rollers mounted rotatably on the platform project slightly above the platform upper surface to support the driving wheels of the wheelchair. One of the rollers is connected to a flywheel which provides momentum to even out the movement of the rollers and the driving wheels between strokes of the person driving the wheelchair. One or more attachment arms hold the wheelchair immovably on the platform when the user is exercising. The arm is split into two arm sections which rotate relative to one another through a third joint. The outer end of one of the arm sections is pivotally attached to the platform through a first joint and the outer end of the other arm section is pivotally attached to a clamp through a second joint. The clamp is configured to quickly and easily attach to the wheelchair frame. A clamp mechanism causes the first, second and third joints to be simultaneously locked immovably upon the activation of a single handle.

U.S. Pat. No. 6,113,519 describes a treadmill device which includes a braking device incorporated in the body of the treadmill and operated for applying a resistance or load against the rotary motion of treadmill rollers on which a wheelchair's side wheels are supported. The angle of inclination of the treadmill rollers may be adjusted according to any variation in the angle of inclination for the wheelchair wheels supported by the treadmill rollers. To this end, the user of the wheelchair can adjust the angle of inclination for the treadmill rollers. A guide member for supporting the front wheel of the wheelchair may also be included, and the guide member can be adjusted to accommodate practically all types and sizes of the wheelchair. A central control panel is provided at a particular single point on the treadmill for enabling the user of the wheelchair to control the braking device, adjust the angle of inclination, and moving the guide member.

U.S. Pat. No. 5,649,883 describes a trainer for use with a three-wheel racer wheelchair and which may be effectively utilized as part of a computerized system for physiological training and simulated road race training. A jack supports the wheelchair frame such that the drive wheels just make frictional driving contact with the crest of one of two of the trainer's rollers. Undesired drag, caused by the weight of the wheelchair and its user, is substantially decreased or virtually eliminated, enhancing the trainer's ability to simulate real road conditions.

U.S. Pat. No. 5,476,429 describes an exercise device for the occupant of a wheelchair acting as a treadmill which may be used for cardiac stress testing, cardiac or stroke rehabilitation, fitness training, aerobic training or educational/physical games, with the device including a generally inclined ramp having parallel sides, a forward entrance portion, a movable dolly mounted on rails on the sides of the ramp, the dolly having a pair of laterally movable caster capture plates with openings to receive the front casters of a wheelchair and angular rods cooperating with the wheelchair drive wheels acting to adjust the lateral spacing of said plates, locking means for the dolly to retain it in its forward position, separate locking means for locking the dolly in its rearward position when a wheelchair has been moved onto the ramp into operative position, a pair of enlarged openings adjacent the rear edge of the ramp, and a pair of longitudinally movable rollers beneath the ramp and movable between a rear retracted position allowing the wheelchair drive wheels to be partially received in the openings and a forward position under the drive wheels to engage and lift the drive wheels so that the user can manually rotate the wheelchair drive wheels to rotate the rollers and provide signals to a control apparatus for the desired type of training, testing or rehabilitation.

U.S. Pat. No. 5,704,876 describes an aerobic wheelchair trainer with variable resistance. The wheelchair trainer includes a ramp having a plurality of level steps. The steps lead a wheelchair inserted into the wheelchair trainer onto a platform. The wheelchair trainer also includes a support mechanism that supports the weight of the wheelchair and wheelchair occupant. A load mechanism including a resistance roller and an eddy current brake is also included. The load mechanism provides a variable resistance to movement of the wheels of the wheelchair. The wheelchair trainer also includes a lift mechanism that lifts the rear end of the wheelchair up and into or out of the support mechanism. The load mechanism is connected to a controller. The wheelchair trainer may be used either individually or may be connected to another compatible wheelchair trainer over a phone line.

Several physiological studies have been conducted on a Wheelchair Aerobic Fitness Trainer (WAFT) devices. While this device is useful for clinical studies, it is large and expensive. There is a need for a reliable and less expensive device for use in homes, hospitals, and schools.

The WAFT device is described in U.S. Pat. No. 4,911,425. The device includes a pair of ramps each including an open front end and a barriered rear end, it being arranged so that their front ends extended in the same direction and are jointly tiltable between a downwardly inclined forwardly facing position and a level position, with the ramps at their respective rear ends each journaling a plurality of rollers that are flywheel effect equipped and that are spaced apart longitudinally of the respective ramps, which rollers are exposed at the top of the ramps, and including a manually operated mechanism for simultaneously tilting the ramps between a tilted wheelchair receiving position, in which the wheelchair user can back his chair onto the ramps while seated in the wheelchair, with the wheelchair rear wheels reaching and resting on the respective sets of ramp rollers, several of which are braked in the ramp tilted position, and the ramp level position, in which the wheelchair front wheels are braked and the wheelchair user can manually actuate the wheelchair rear wheels for exercise purposes. The rearmost of the respective sets of ramp rollers are equipped to provide independently adjustable resistance at the option of the user.

SUMMARY OF INVENTION

General Description

The current invention provides an improved method and apparatus for providing exercise from a wheelchair.

One aspect of the current invention is the deliberate raising of the rear wheelchair wheels, and the holding of the rear wheels against independent resistance members such as flywheels.

In one embodiment, the device may be instrumented so that the calculation of energy and work performed is straightforward once the rotational speed of the device components are measured.

Chair Wheel Lift Means

One aspect of the invention is a simple mechanism to engage the rear wheels of the wheelchair with a resistance means so that the occupant can exercise from a set position. One benefit of a lift mechanism is that the device can be provided with a much smaller footprint and weight as compared to prior art ramp devices where the wheelchair is driven up a ramp to access the resistance means.

In one embodiment, a lever-driven cam means is provided so that the occupant may raise and lower the rear wheels by simple movements of one or more levers in a single movement. In another embodiment, a hydraulic lift means such as a manual or electric jack is provided to lift the rear portion of the wheelchair. In another embodiment, a gear lift means is provided so that the gears can be driven by the single-action or ratchet-action of one or more levers. Variations of these lift means and other aspects of the invention will be apparent to one skilled in the art, and the current invention is not limited to the specific embodiments described below.

One aspect of the current invention is to provide a device that may be used without need for ramps. In one embodiment, the total lift distance of the rear wheelchair wheels is approximately one inch. For a two foot spacing between the rear axle and the front wheels, the one inch height represents an inclination angle of the chair of less than 2.4 degrees; or about ½ of the national accessibility standards for wheelchair ramp inclination of no greater than 1 inch of rise per 12 inches of run. As discussed in more detail below, this low lift height results from several factors including elimination of the need to lift the rear wheelchair wheels completely over a roller; and a retention means that provides an effective thrust force of the rear wheels against a wheel engagement means at a relatively low thrust angle. In some embodiments, the retention means is adjustable to permit further optimization of thrust angle and roller diameters.

Wheel Resistance Means

Another aspect of the current invention is the combination of a wheel engagement means that is driven by a wheelchair rear wheel, and a flywheel which provides a known inertial resistance to the rotation and acceleration of the wheelchair wheel. Although other arrangements are possible, the wheel engagement means and the flywheel are typically mounted on an axle so that a separate axle wheel engagement means and flywheel are provided for each wheelchair rear wheel.

In one embodiment, the wheel resistance means is two independent flywheels such that each flywheel provides a separate resistance to a single rear wheelchair wheel. In this embodiment, the wheelchair wheels may be operated independently.

The wheel engagement means typically is provided in a diameter of about 5 to 8 inches for a standard wheelchair wheel diameter of 24 to 27 inches. These diameters result in a gearing for the device up to 1 to 5, so that as a wheelchair wheel is turned at a first speed, the wheel engagement means and flywheel turn up to 5 times faster than the wheelchair wheel. In combination with a flywheel, this gearing ratio permits an effective exercise device to be provided within a limited footprint and with a relatively low weight. The length of the wheel engagement means is typically several inches in order to provide for a range of widths of wheelchairs, and to allow some tolerance in centering the wheelchair on the trainer.

Flywheels may be commercially available disks, such as Olympic style lifting weights. Alternately, custom flywheels may be produced, such as by casting, to take advantage of the inertial properties of a flywheel by moving most mass to an outside ring. In some examples, the flywheel and the wheel engagement means may be cast as a single part with different diameters in order to reduce part count and assembly time. In some embodiments, the axles may be extended beyond the flywheels so that supplemental weights may be removable attached to the axle. In some embodiments, a variable resistance may be obtained by applying a mechanical, magnetic, hydraulic, or electro-mechanical resistance to the flywheel. In some embodiments, a variable resistance may be obtained by applying a mechanical, magnetic, hydraulic, or electro-mechanical resistance directly to a wheel engagement means so that a separate flywheel is not required.

Wheelchair Retention Means

Another aspect of the current invention is a simple mechanical wheelchair retention means to hold the rear wheelchair wheels against the wheel engagement means. In one embodiment, the wheelchair lift means raises a pivotal frame member or a platform to which one or more inclined elements are attached. These inclined elements may be a simple inclined plate, simple blocks with an inclined or arced contact surface, or they may be simple extensions of the pivotal frame or platform.

The wheelchair retention means is typically adjustable so that the normal force of the wheelchair wheels against the wheel engagement means is in the range of 10 to 45 degrees relative to the horizontal plane. An angle of 45 degrees provides a maximum force against the wheel engagement means, but it is generally not necessary or desirable to use this maximum force. An angle of about 20 degrees is generally sufficient to provide a safe and consistent contact force without applying too much compression to the wheelchair wheels. An angle of about 20 degrees in combination with 6 inch diameter wheel engagement means appears to be effective in test devices. The adjustment is preferably provided in both a z-axis height relative to the wheel engagement means, and in an x-axis distance from the wheel engagement. In some cases, it is also desirable to provide a pair of retention blocks and to provide a y-axis adjustment for the separation distance between the blocks in order to accommodate various widths of wheelchairs.

In one embodiment, a retention plate frame is raised and lowered with a cam mechanism. A retention plate has a first end pivotally attached to the retention plate frame, and a second end supported by a height-adjusting mechanism. This height-adjustment mechanism is set for a particular wheelchair so that the rear axle of the wheelchair is only slightly higher than the second end of the retention plate. The cam mechanism is then used to raise the wheelchair by engaging the rear axle with the retention plate.

In another embodiment, a pair of inclined blocks are provided on a moveable support platform so that as the platform is raised, a portion of each block engages a portion of the rear axle of the wheelchair so that the axle is raised and driven backwards slightly and the wheelchair wheels are pressured more into the wheelchair wheel engagement members. One variation of this approach includes the use of arced blocks, such as a concave surface, to improve the position versus force characteristics of the retention device. Other variations include the use of a single retention member, and the ability to easily adjust the position of the retention member relative to the frame or platform to compensate for various wheelchair frame dimensions. For collapsible wheelchairs without a rear axle, and adaptor may be provided.

Instrumentation

In some embodiments a simple measurement of the rotational speed of the flywheels, in combination with the known resistance of device, can provide information about acceleration, force and torque, work, energy, power and caloric expenditure, and equivalent translational speeds and distance traveled.

In some embodiments, physiological measurements may be combined with the speed measurements and force calculations, and the device can serve as a simple physiological study device.

In some devices, a variable resistance can be provided to establish a programmable resistance such as that provided in treadmills and exercise bicycles in order to provide a planned exercise routine.

Virtual Reality

In some embodiments the device measurements may be used in combination with computer gaming to provide a virtual reality environment or remote competition system.

DETAILED DESCRIPTION OF EMBODIMENT

Trainer with Cam Lift Means

One embodiment of the current invention is a trainer with a cam lift means to lift the rear wheels of a wheelchair. The wheels are then forced into contact with a wheel resistance means. The wheels are kept in place against the wheel resistance means with a wheelchair retention means. In one example, the wheel resistance means is a pair of flywheels, and the wheelchair retention means is at least one block that engages the rear axle of a wheelchair.

Other variations of wheelchair lift means are described in other embodiments below. Each of these embodiments may incorporate variations in the wheel resistance means, the wheelchair lift means, and the wheel resistance means.

Figure 1:
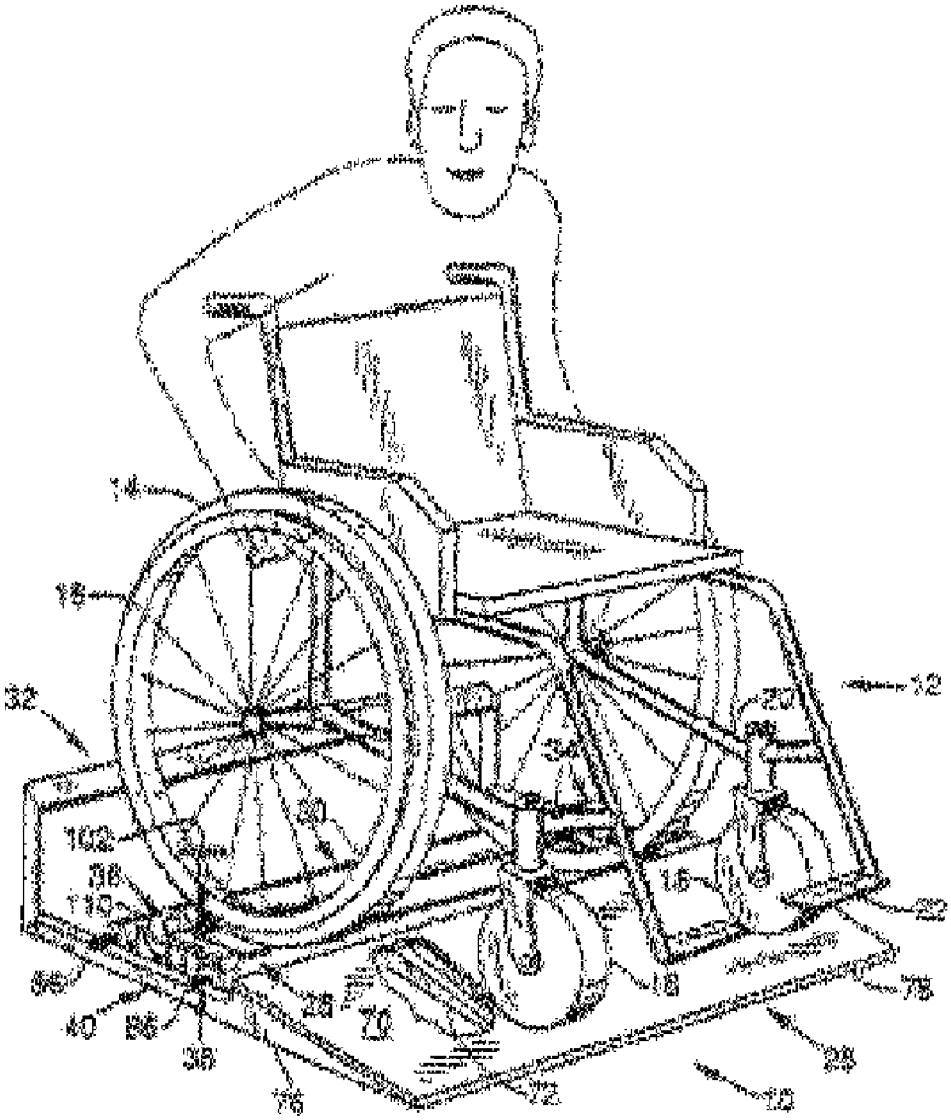
FIG. 1 is a perspective view of a prior art trainer with a pair of elongated rollers.
Figure 2:
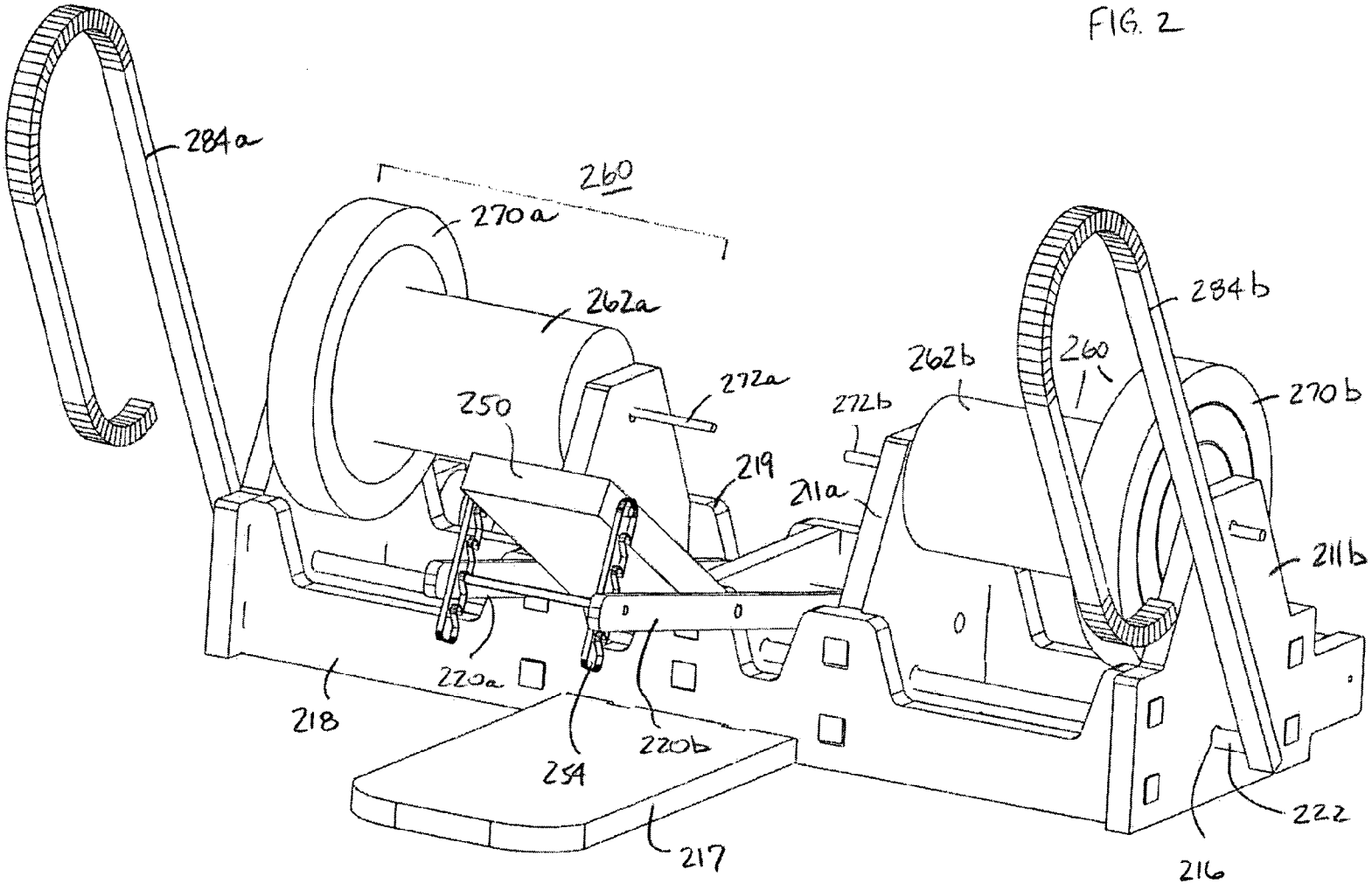
FIG. 2 is a front perspective view of a wheelchair aerobic stationary exercise device

FIGS. 2-13 are various views of one embodiment of a wheelchair trainer 200 which is described more fully below. This embodiment includes flywheel resistance and a cam lift means 280. FIG. 2 is a front perspective view of the device.

Figure 3:
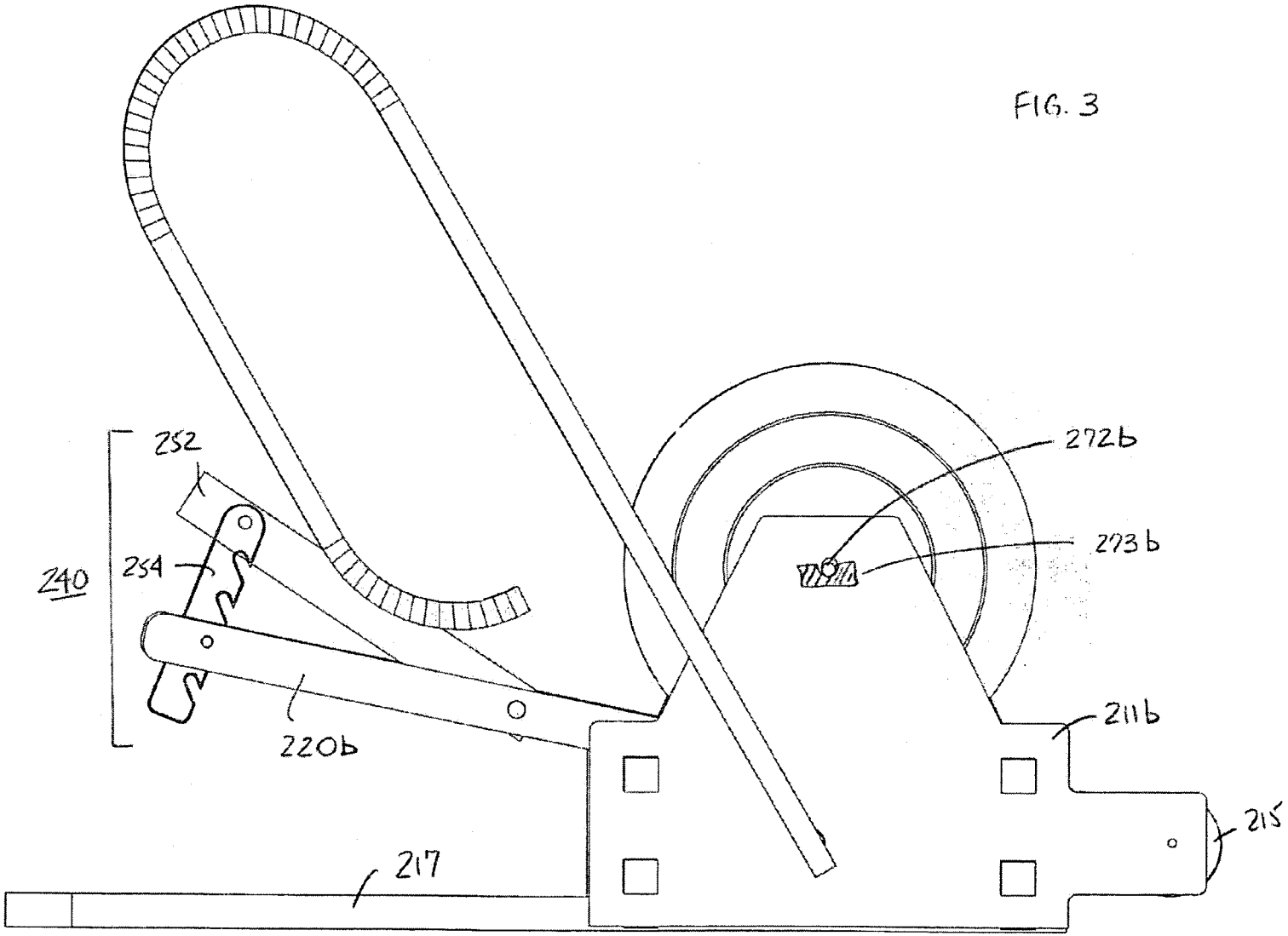
FIG. 3 is a side view of the exercise device of FIG. 2
Figure 4:
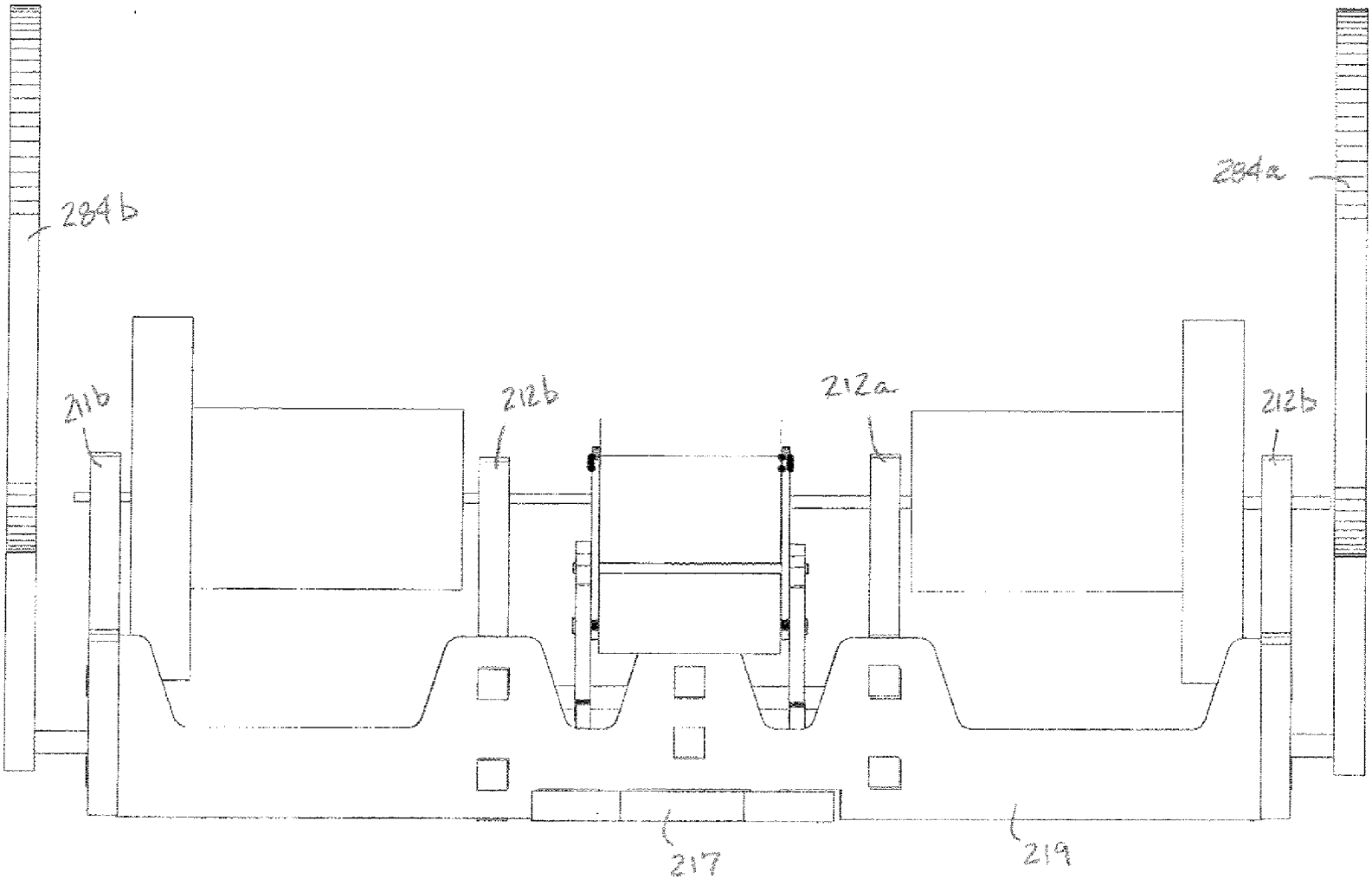
FIG. 4 is a front view of the exercise device of FIG. 2
Figure 5:
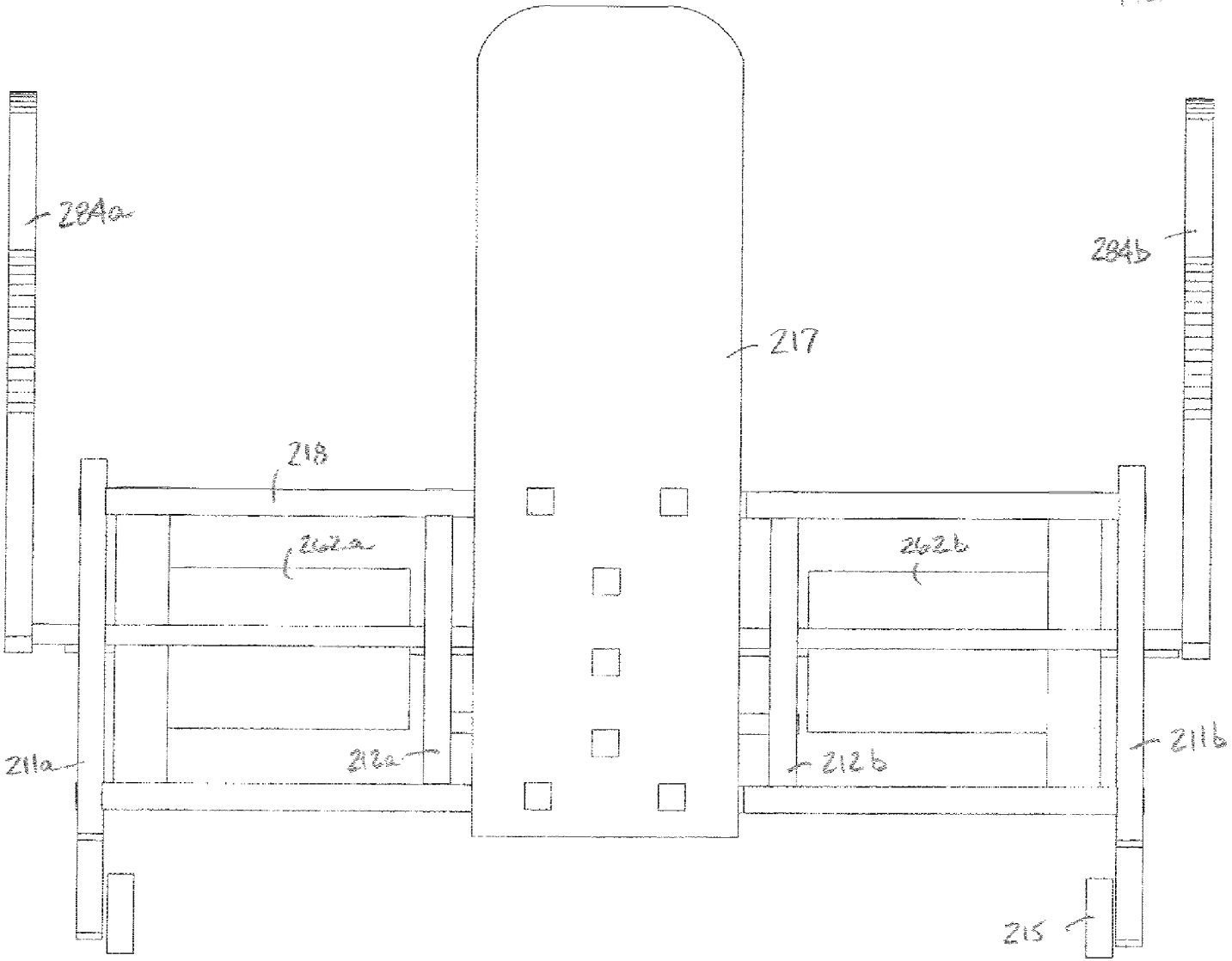
FIG. 5 is a bottom view of the exercise device of FIG. 2
Figure 6:
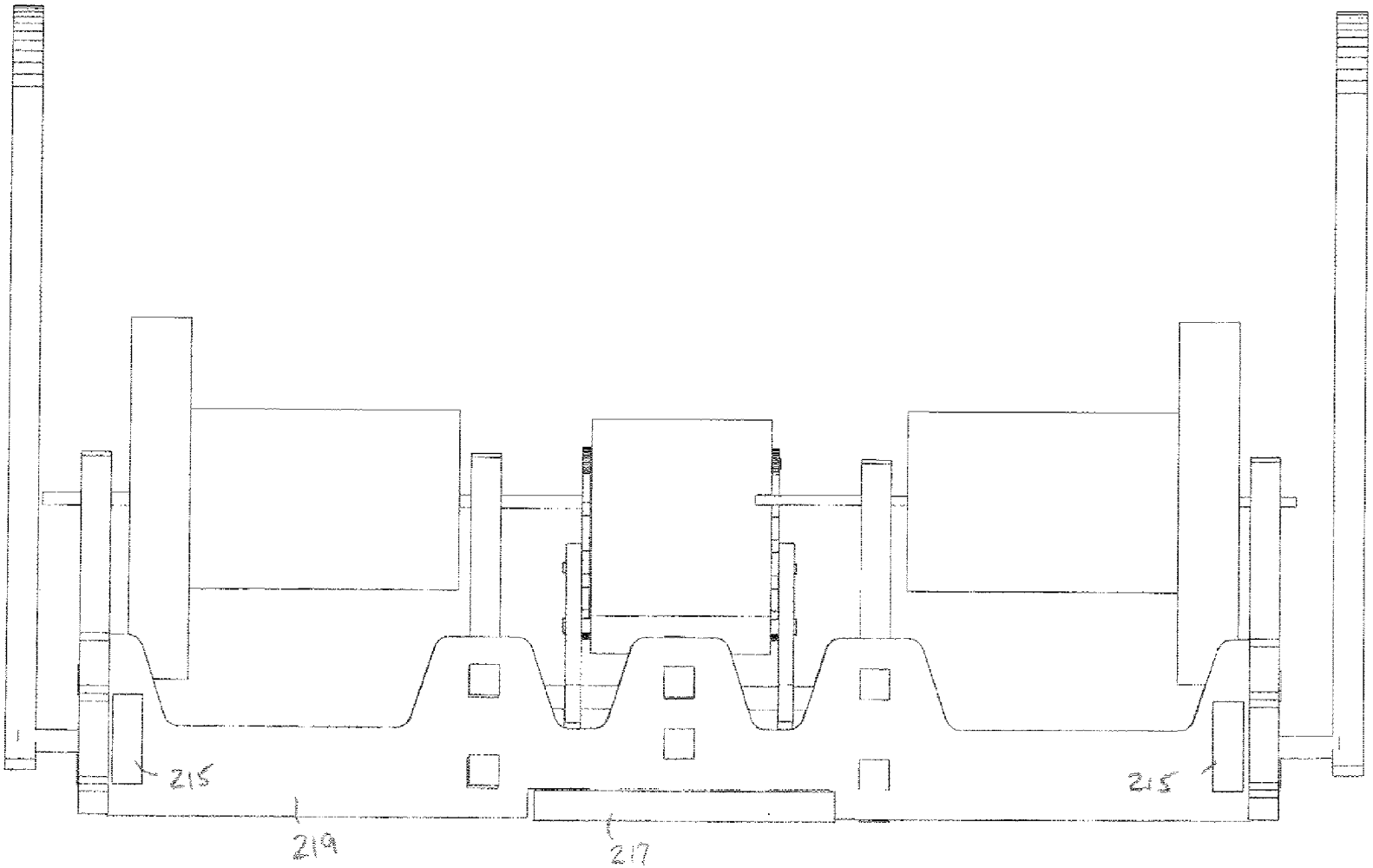
FIG. 6 is a rear view of the exercise device of FIG. 2
Figure 7:
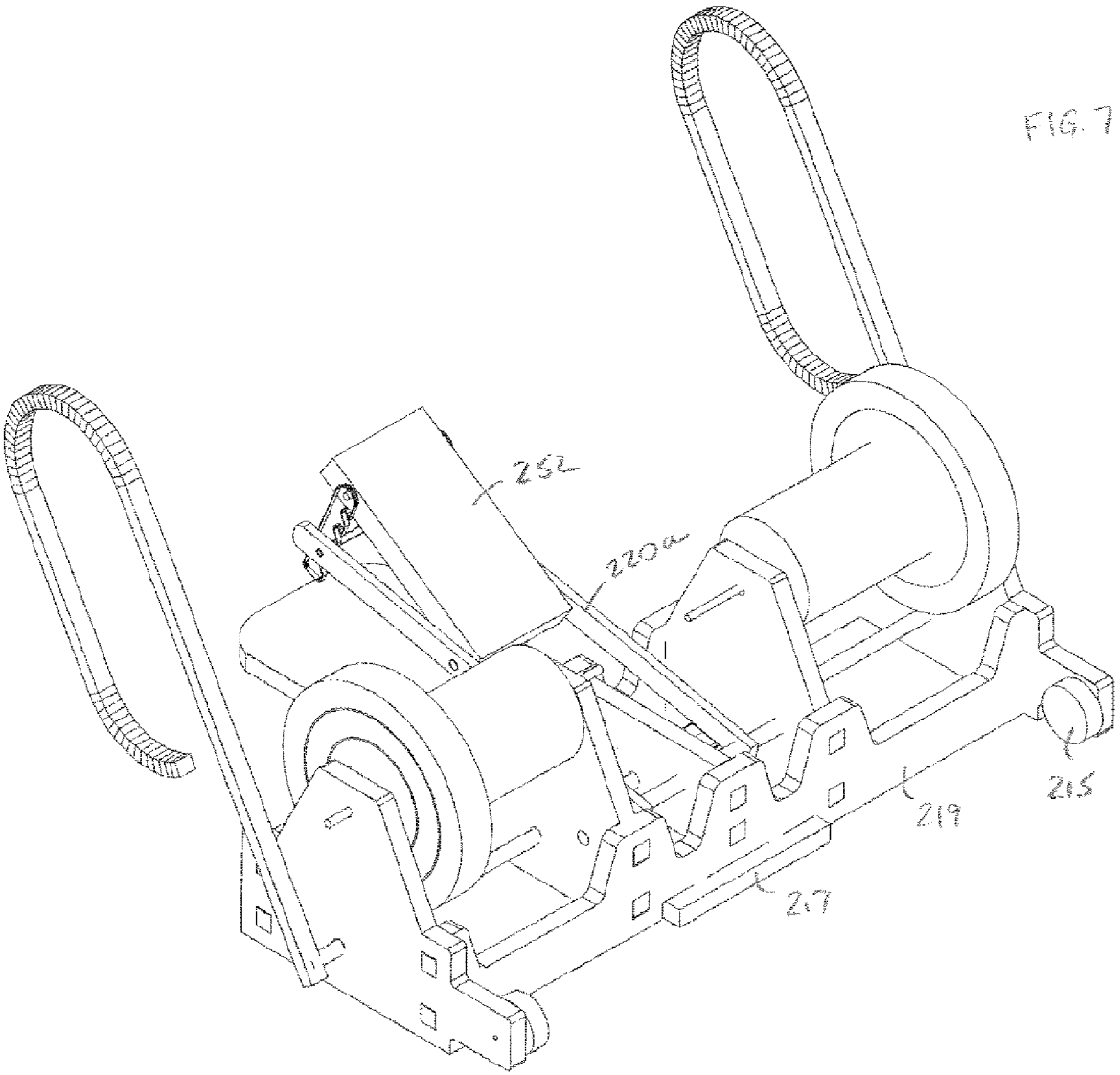
FIG. 7 is a rear top perspective view of the exercise device of FIG. 2
Figure 8:
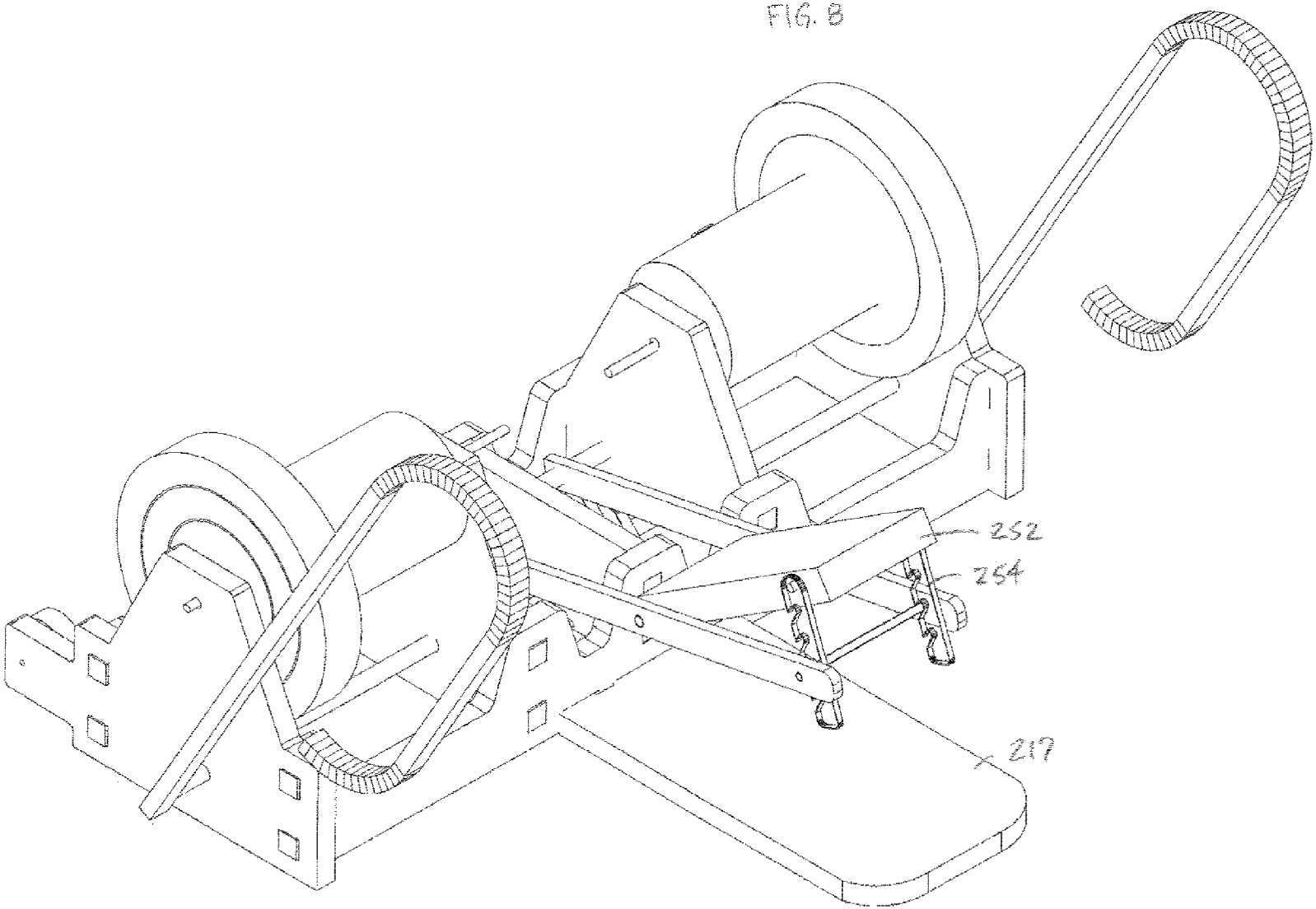
FIG. 8 is a front top perspective view of the exercise device of FIG. 2
Figure 9:
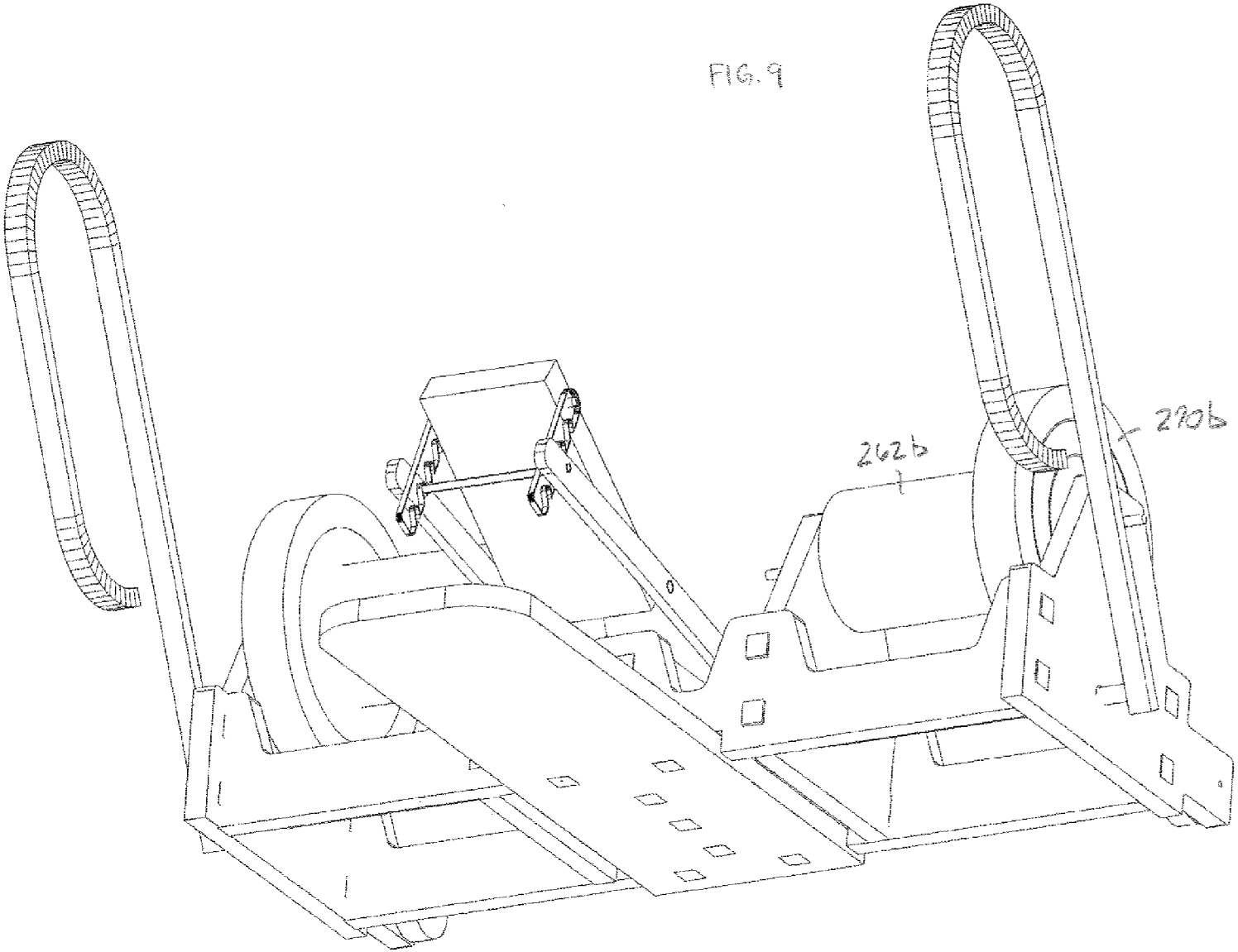
FIG. 9 is a bottom perspective view of the exercise device of FIG. 2
Figure 10:
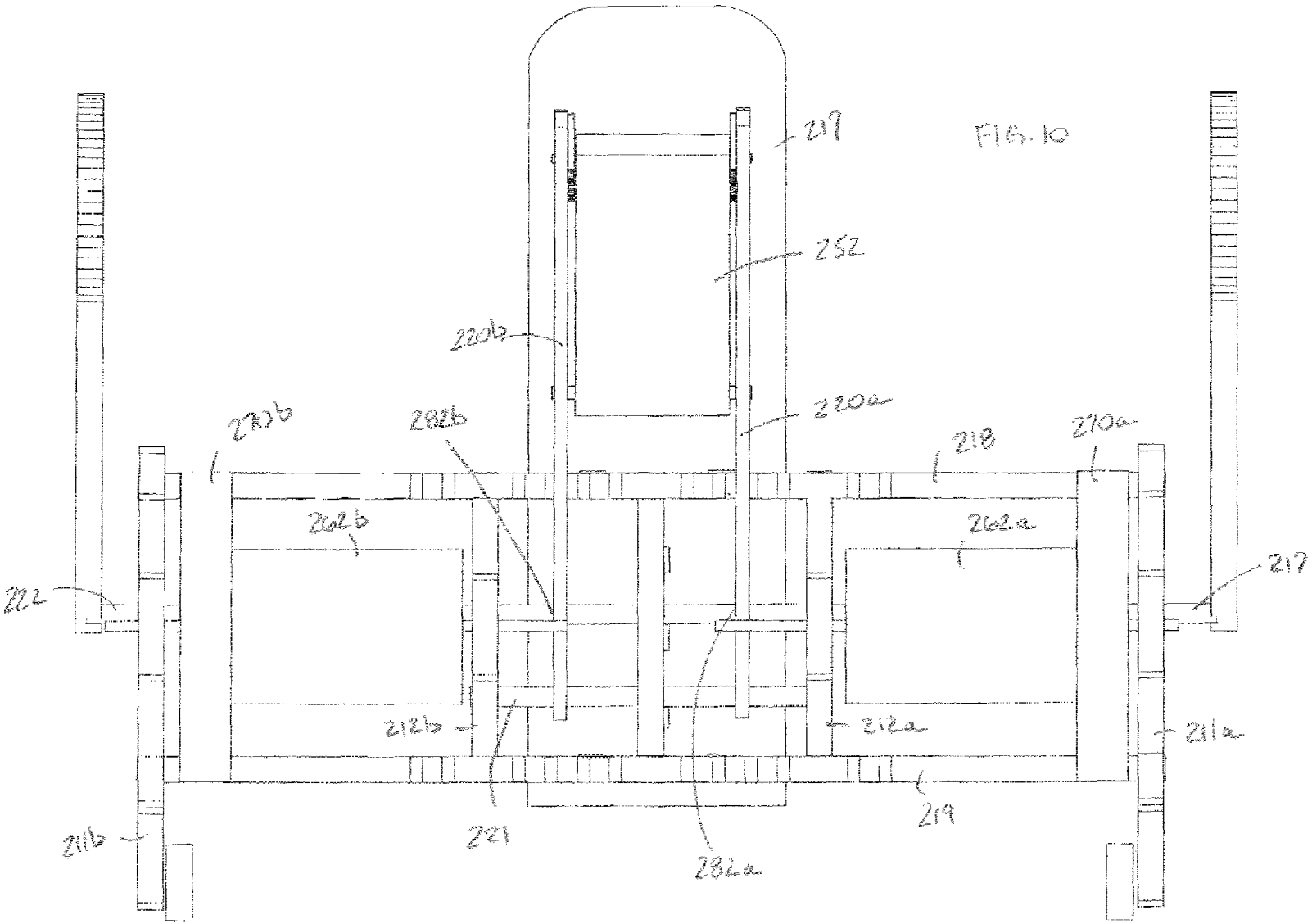
FIG. 10 is a top view of the exercise device of FIG. 2
Figure 11:
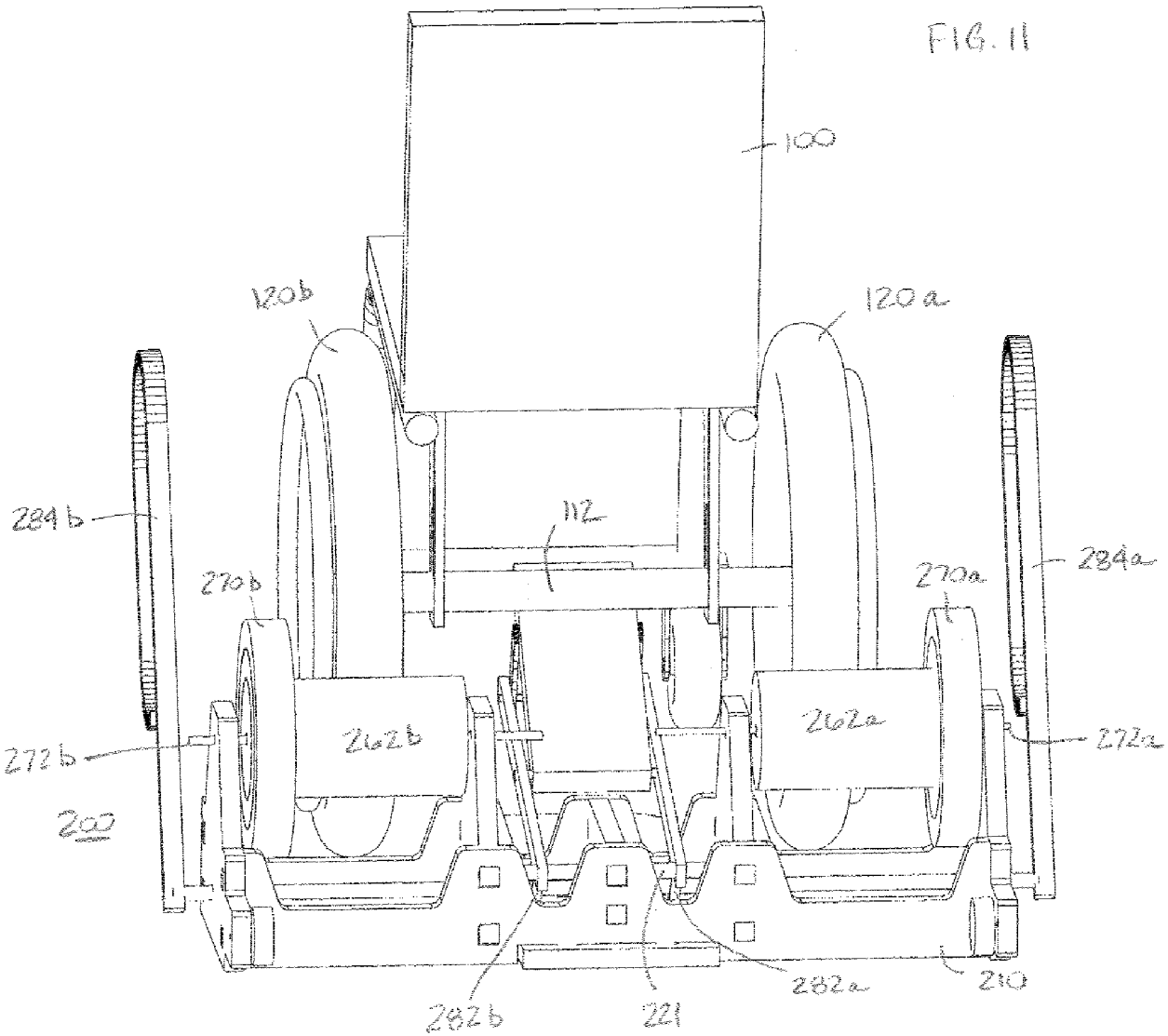
FIG. 11 is a rear perspective view of the exercise device of FIG. 2 with a wheelchair held in position against the rear wheel engagement means.
Figure 12:
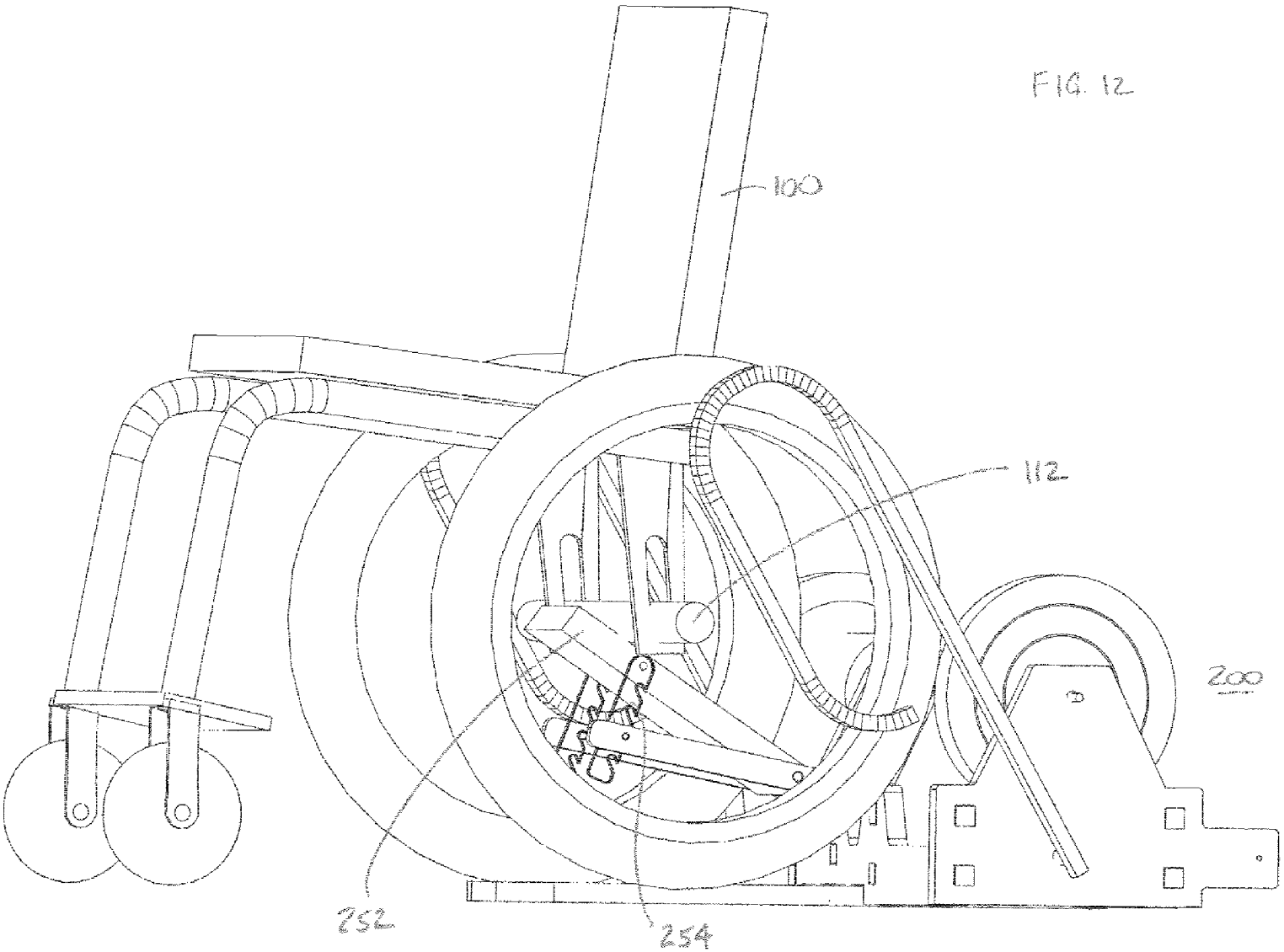
FIG. 12 is a side perspective view of the exercise device of FIG. 2 with a wheelchair held in position against the rear wheel engagement means.
Figure 13:
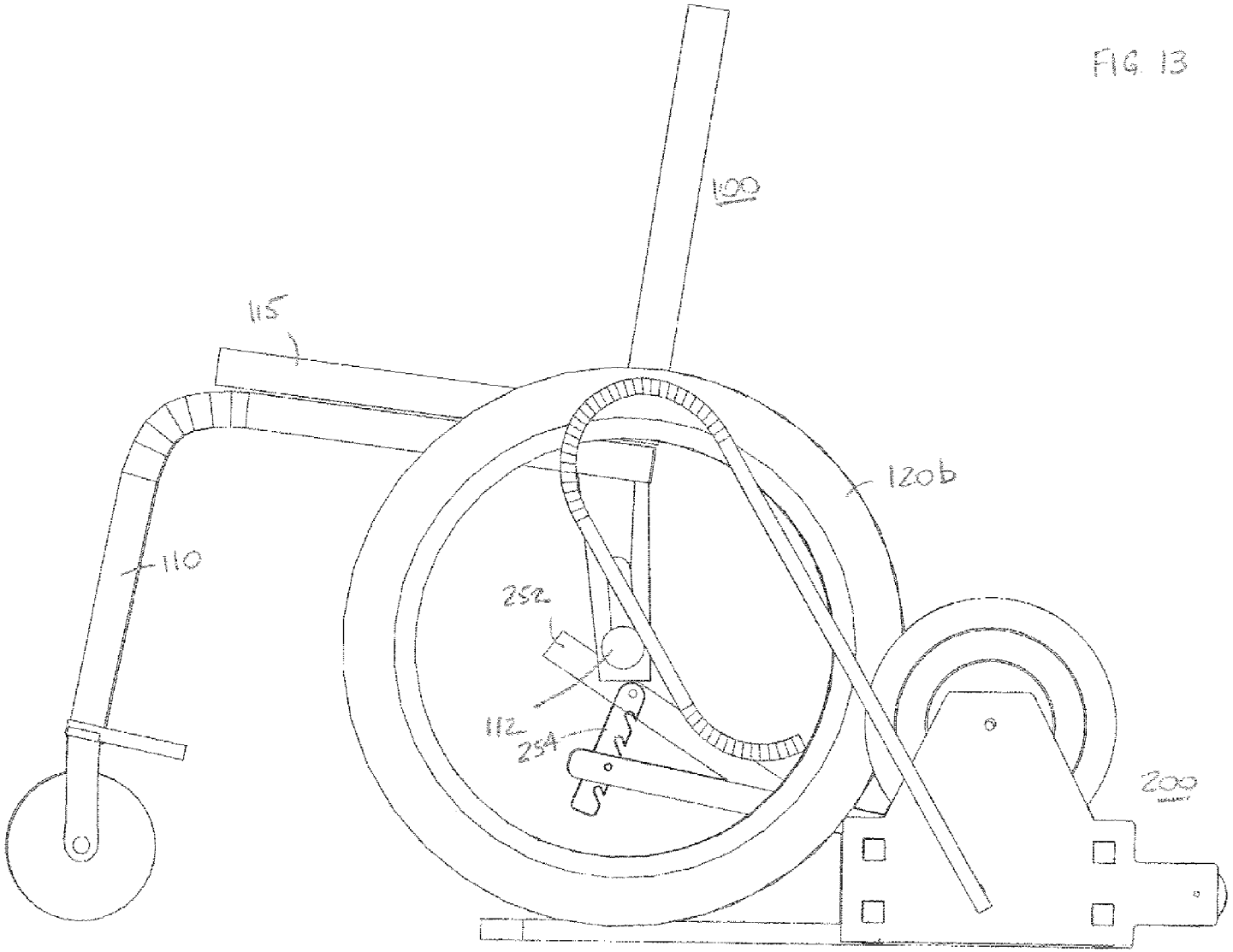
FIG. 13 is a side view of the exercise device of FIG. 2 with a wheelchair held in position against the rear wheel engagement means.

FIG. 3 is a side view of the device. FIG. 4 is a front view of the device. FIG. 5 is a bottom view of the device. FIG. 6 is a rear view of the device. FIG. 7 is a rear top perspective view of the device. FIG. 8 is a front top perspective view of the device. FIG. 9 is a bottom perspective view of the device. FIG. 10 is a top view of the device. FIG. 11 is a rear perspective view of the device with a wheelchair held in position against the rear wheel engagement means. FIG. 12 is a side perspective view of the device with a wheelchair held in position against the rear wheel engagement means. FIG. 13 is a side view of the device with a wheelchair held in position against the rear wheel engagement means.

Wheelchair

FIG. 13 is a side view of a wheelchair 100 positioned on the trainer. In this embodiment, as in most embodiments described below, the wheelchair is a standard fixed chair comprising a frame 110 with a seat 115. The chair includes an axle 112 which supports a right rear wheel 120*a* and a left rear wheel 120*b*. In an alternate embodiment described below, the wheelchair does not have a fixed axle between the rear wheels. One approach to using the trainers described in this embodiment is to provide an adaptor and an axle so that the wheelchair retention means may engage the adaptor axle. In other embodiments, an alternative wheelchair retention means may be provided.

Frame

In this embodiment, an interlocking frame 210 provides support for the flywheels, for the lift means, and for the chair retention means. The frame includes flywheel support elements 211*a* and 212*a* which support the right flywheel 270*a*; and flywheel support element 211*a* and 212*b* which supports the left flywheel 270*b*. The frame also includes a base 217, a front element 218, and a rear element 219 which interlock with the flywheel support elements. This frame may be constructed of a plastic, wood, or other material. One advantage to this frame design is that the frame elements can be quickly assembled without tools. Another advantage is that the frame members can be easily fabricated such as by routing the frame elements or by molding the elements. Other frame designs may be used.

The frame may include small wheels 215 to permit the device to be tilted and rolled to a desired location.

The frame includes a cam support elements 216 which support a cam axle 222. In one example, the cam support elements are bushings. In another example, the cam support elements are axle supports such as shown by element 273*b* in FIG. 3. The axle supports may be small plates with rounded slots to receive and support axles, and may be made of Oil-Lite™ bronze—an 18% oil-impregnated bronze, or Nylon 6 with molybdenum disulphide, or other material. These materials may be routed to a desired shape and are replaceable.

In this example, the frame also includes chair retention block support platform support members 220*a* and 220*b* which raise and lower a retention plate 252.

Chair Retention Means

In this embodiment, the chair retention means comprises a retention plate 252 which engages the rear axle or frame of a wheelchair. The retention plate is raised or lowered by a lift means so it engages a portion of the rear wheelchair axle, lifts the axle slightly, and forces the axle backwards so that the rear wheels engage a wheel engagement means.

In this example, a height-adjustment means 254 is provided to adjust the lowered height of the retention plate 252

In another example, the chair retention means 240 includes a frame and retention block support platform. In this example, a pair of concave blocks is provided on the platform.

The pair of blocks includes a right concave retention block, and a left concave retention block. These blocks may be fixed relative to the platform, or the position of one or both blocks may be adjusted with a right block adjustment means, and a left block adjustment means. The retention blocks may be plastic automobile wheel chocks.

In one example, the retention block support platform, is provided as a first platform about 12 inches square that is fixed relative to the retention block support platform support member, and a second platform of similar size that is height-adjustable relative to the first platform. This configuration permits a simple height adjustment for the retention blocks which are mounted in a horizontally-adjustable fashion on the second plate. In this example, a z-axis adjustment is provided by raising or lowering the second plate relative to the first plate, and a y-axis adjustment is provided by adjusting the block positions on the second plate.

Wheel Resistance Means

In this embodiment, the wheel resistance means 260 includes wheel engagement means which is rotated by a rotating wheelchair wheel, and flywheels which provide resistance to the rotation of the wheel engagement means and the wheelchair wheel.

Wheel Engagement Means

The right rear wheel engagement means 262*a* engages the right rear wheel 120*a* of the wheelchair so that as the right rear wheel is turned, the wheel turns in one direction, clockwise or counterclockwise, the right rear wheel engagement means is turned in the opposite direction, counterclockwise or clockwise.

The left rear wheel engagement means 262*b* engages the left rear wheel 120*b* of the wheelchair so that as the left rear wheel is turned, the wheel turns in one direction, clockwise or counterclockwise, the left rear wheel engagement means is turned in the opposite direction, counterclockwise or clockwise.

The right rear wheel engagement means may be turned in the same direction and speed as the left rear wheel engagement means. Alternately, one of the engagement means may be stopped while the other engagement means is turned. Alternately, one of the engagement means may be turned faster than the other engagement means is turned. Alternately, one of the engagement means may be turned in one direction, and the other engagement means may be turned in the opposite direction.

In this embodiment, each wheel engagement means is placed on an axle 272*a* and 272*b* which also supports a separate flywheel. These axles can be supported by bushings, or by other axle support means such as the axle supports described above.

In other embodiments, the flywheel may be part of the wheel engagement means—either as a constant diameter element, or as a casting which has a first diameter for wheel engagement, and a greater second diameter for improved inertial characteristics. One advantage of a separate flywheel is the ability to improve or optimize inertial characteristics with respect to overall device weight. For example, a solid disk requires more mass for an equivalent inertial resistance for a given diameter than a flywheel where the mass is concentrated in an outer ring.

Another advantage of separate components for the wheel engagement means and the flywheel is that a flywheel typically is made predominantly of a high density material such as iron, while a wheel engagement means may be made of a lighter weight polymer material such as Schedule 80 PVC pipe. The wheel engagement means need not be a polymer, and a test unit of the current invention was made using concrete cylinders as wheel engagement means.

The diameter of the wheel engagement means is typically in the range of about 5 to 8 inches (about 12 to 20 centimeters). The smaller the diameter of the wheel engagement means, the faster that the flywheel will turn for each revolution of the wheelchair wheel. While this gearing ratio is generally desirable, too small of a diameter will tend to cause slipping of the wheelchair wheel at the wheel engagement means and the requirement of excessive "road resistance" to overcome the slippage.

In one example, the wheel engagement means is provided as a cylinder of HDP, nylon, urethane, or other plastic or polymer. The cylinder has a diameter of about 6 inches (15.2 cm) and has a length of about 6 inches (15.2 cm).

Flywheel

In this embodiment, a pair of flywheels is provided—one for each wheelchair rear wheel.

The right flywheel 270*a* is mounted on the right flywheel axle 272*a*. In this example, a single flywheel is used for the right side resistance. In other examples, a supplemental weight may be added to the flywheel, such as by inserting an additional weight on an extended portion of the right flywheel axle. In other examples, a variable resistance may be obtained from the flywheel. In this example, the right flywheel axle is supported by an axle support block 273*a*.

The left flywheel 270*b* is mounted on the left flywheel axle 272*b*. In this example, a single flywheel is used for the left side resistance. In this example, the left flywheel axle is supported by an axle support block 273*b*.

Equivalent Inertia, Thrust, Fixed Mass, and Safety

The total energy of the stationary system is equated to the total energy of a wheelchair in linear motion. A wheelchair in linear motion has a kinetic energy related to the mass of the occupant and wheelchair and the linear speed; and a rotational energy component related to the moment of inertia and the speed of rotation of the wheelchair wheels. The stationary system has two rotational kinetic energy components—the rotational energy related to the moment of inertia of the wheelchair wheels and the speed of their rotation; and the rotational energy related to the moment of inertia of the flywheels and wheel engagement means and the speed of wheel engagement means' rotation. When equations for the stationary and linear motion are equated, the rotational kinetic energy of the wheelchair wheels is common to both sides, and as a result, the linear translational energy of the occupant and wheelchair mass is directly related to the rotational energy of the flywheels and wheel engagement means.

$$\text{Kinetic Energy of Translation}=\tfrac{1}{2}MV^2 \quad \text{[EQ. 1]}$$

$$\text{Rotational Energy}=I_{Flywheel}\Omega_{Flywheel}^2+I_{wheel\ engagement\ means}\Omega_{wheel\ engagement\ means}^2 \quad \text{[EQ. 2]}$$

$$\tfrac{1}{2}MV^2\approx I_{Flywheel}\Omega_{Flywheel}^2+I_{wheel\ engagement\ means}\Omega_{wheel\ engagement\ means}^2 \quad \text{[EQ. 3]}$$

$$V=\Omega_{wheelchair\ wheel}R_{wheelchair\ wheel}=\Omega_{wheel\ engagement\ means}R_{wheel\ engagement\ means} \quad \text{[EQ. 4]}$$

$$\Omega_{Flywheel}=\Omega_{wheel\ engagement\ means} \quad \text{[EQ. 5]}$$

Example

Assuming a 180 pound occupant and a 20 pound wheelchair, a 6 inch diameter wheel engagement means (contact wheels) and 12 inch diameter uniform disk flywheels; two 50 pound flywheels could be used to provide equivalent rotational inertia & kinetic energy and thus the sense propulsion & travel on flat terrain.

Example

Olympic weights have a thin circular disk with the bulk of the cast iron mass as a widened perimeter ring, as would be a design option for optimized flywheels. In this example, two 35 Olympic weights could be used in lieu of two 501b weights of the same diameter, as their rotational inertias are equivalent.

A typical total flywheel inertial mass is provided to approximate 200 pounds of translational mass. This mass accommodates the average wheelchair user and wheelchair weight. The device uses a concept of equivalent inertia, but is also able to provide that equivalent inertia with a relatively low flywheel mass because of the inertial characteristics of the flywheels. For example, the 200 pounds of translational mass can typically be approximated with total flywheel mass of 70 to 100 pounds, depending upon the diameter and shape of the flywheels and the diameter of the wheel engagement means (contact wheel) which determine the rotational speed of the connected flywheels and wheel engagement means.

In one embodiment, a thrust angle is provided in a range of about 10-45 degrees, with about 20 degrees being a typical angle of contact between the rear wheelchair wheels and the wheel engagement means. This relatively low thrust angle provides several advantages over prior art devices.

One advantage is in the total lift height required to engage the wheel resistance. Whereas prior art devices require lifting the rear wheels completely over a resistance roller, the current invention requires only about 1 inch of lift. For example, a prior art double roller device requires lifting the rear wheelchair wheels 120*a* and 120*b* into a position over a first roller to a rest position between a first roller and a second roller. Several linear feet of inclined ramps are necessary to raise the wheelchair to this height. For example, general ramp safety guidelines suggest not exceeding a pitch of 1:12.

Figure 17:
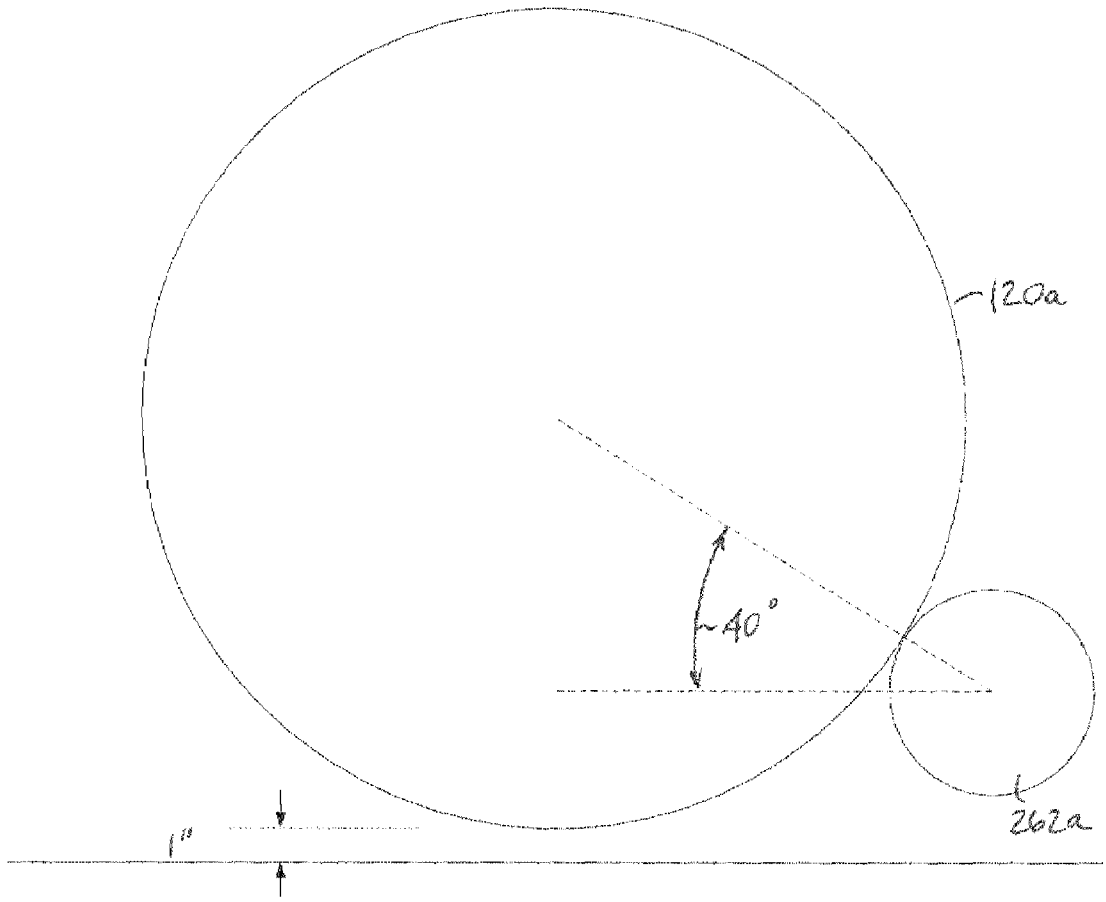
FIG. 17 is a diagram of one embodiment of the current invention with 24 inch diameter wheelchair wheels with one inch ground clearance, and a 6 inch diameter wheel with a 40 degree thrust angle.
Figure 18:
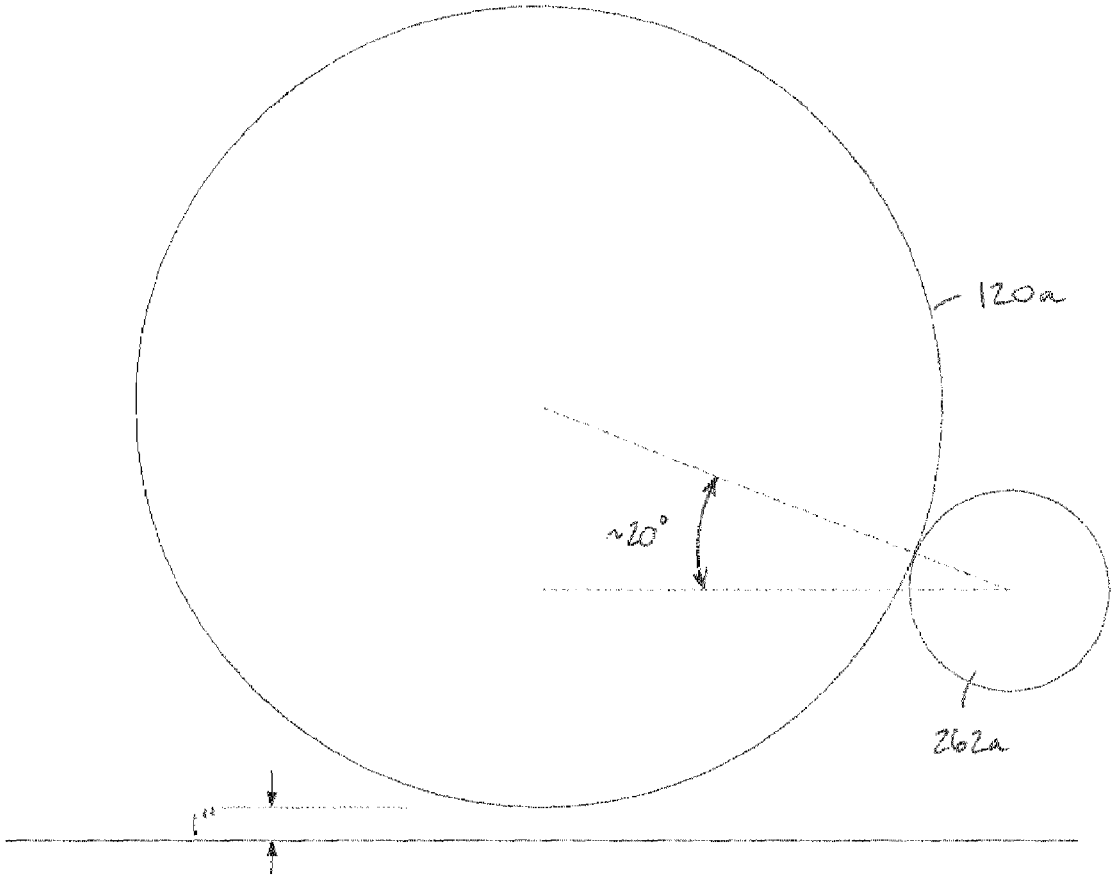
FIG. 18 is a diagram of one embodiment of the current invention with 24 inch diameter wheelchair wheels with one inch ground clearance, and a 6 inch diameter wheel with a 20 degree thrust angle.

FIG. 17 is a side view of one embodiment of the current invention with a 24 inch diameter right wheelchair wheel 120*a*, a 6 inch diameter right wheel engagement means 262*a* with 1 inch ground clearance, and a 40 degree thrust angle. In this example, the wheelchair wheels are lifted only about 1 inches. FIG. 18 is a side view of one embodiment of the current invention with a 24 inch diameter right wheelchair wheel 120*a*, a 6 inch diameter right wheel engagement means 262*a* with 1 inch ground clearance, and a 20 degree thrust angle.

FIG. 19 is a force diagram and calculations for a wheel retention means and a wheel engagement means.

Another advantage to the low thrust angle is that it is adjustable by changing the vertical or horizontal position of the retention blocks. A single fixed mass flywheel system can provide an effective range of "road resistance" between the wheelchair tire and wheel engagement means by adjusting the thrust angle.

Another advantage to the low thrust angle is safety. The total height of left of the wheelchair is minimized. When engaged, the retention blocks resist side to side movements of the wheelchair and help to hold it in place. A low thrust angle provides a minimum resistance to motion, so that excessive forces are not required in order to roll the wheels, and thus minimizes "road resistance."

Cam Lift Means

In this example, the rear wheel axle 112 of the wheelchair is lifted by a cam lift means 280. A right cam 282*a* and a left cam 282*b* are affixed to a cam axle 286. The cam axle is connected to a right lever, and to a left lever. The cam axle may be turned in a forward direction by pushing either the right lever or the left lever in a forward direction.

When the cam axle is rotated in the forward direction, the right cam acts on the right chair retention block support platform support member 220*a*, and the left cam acts on the left chair retention block support platform support member 220*b*, thereby pivoting both chair retention block support platform support members and raising the chair retention plate 252.

In this example, when the chair retention block plate is raised, the plate engages the rear axle 112 of the wheelchair.

When the cam axle is rotated in the reverse direction, the right cam acts to lower the right chair retention block support platform support member 220*a*, and the left cam acts to lower the left chair retention block support platform support member 220*b*, thereby pivoting both chair retention block support platform support members and lowering the chair retention plate. In this example, when the chair retention plate is lowered, a right concave retention block and a left concave retention block are lowered and disengage the rear axle 112 of the wheelchair. As the chair retention plate is further lowered, below the wheelchair axle, the wheelchair may be driven away from the trainer device.

Method of Operation

Figure 14:
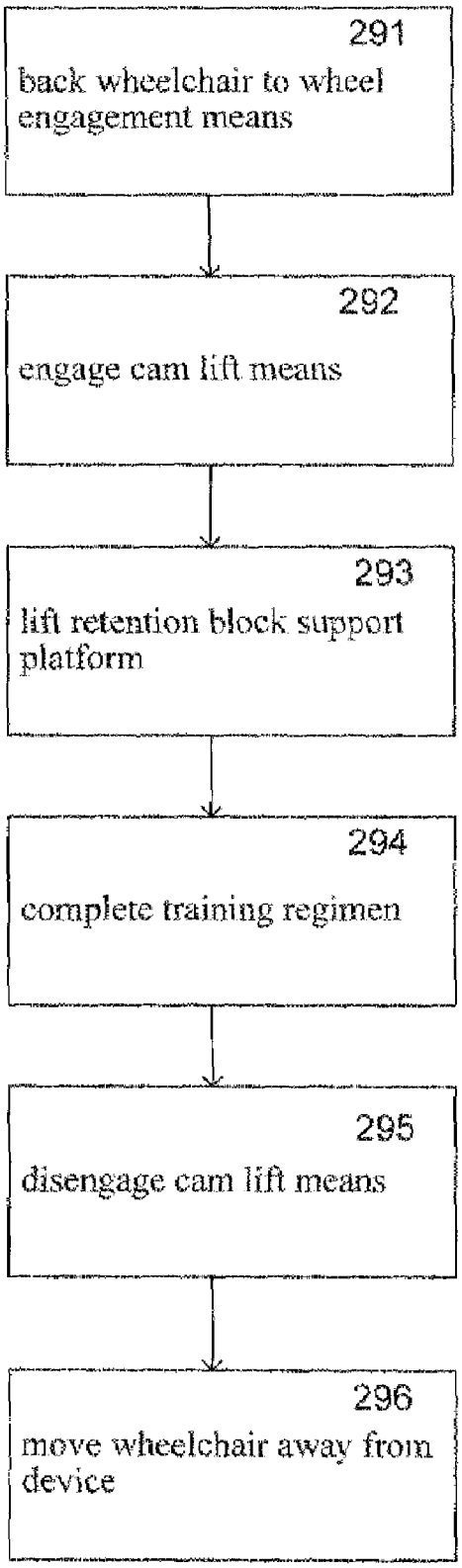
FIG. 14 is a flowchart for steps for using a trained with flywheel resistance and a cam lift means.

FIG. 14 is a flowchart for steps for using a trained with flywheel resistance and a cam lift means.

At step 291, the wheelchair is backed to the proximity of wheel engagement means 262*a*, 262*b*. In this embodiment, the chair is backed so that the rear axle passes over the top of the chair retention plate. In this embodiment, each wheel engagement means has a length of about 6 inches (15.2 cm) so that there is a width tolerance for each wheel, and the WHEELCHAIR need not be exactly centered on the device.

At step 292, the cam lift means is employed by pushing either of or both of the right lever and the left lever. One advantage to this cam embodiment is that a single action on a lever will fully engage the cam and lift the chair retention block support platform 250 with a single lever motion. In other embodiments as described below, a ratchet-type motion may lift the chair retention plate to the desired height. As the chair retention plate is raised, the plate engages the wheelchair rear axle as described above. In this example, the cam is held in place by a portion of the weight of the wheelchair and occupant until the cam is released by the user.

At step 293, after the cam means lifts the chair retention plate to its desired position, the user is ready to use the trainer in an exercise mode. At this point, the user may turn either or both rear wheels in either a forward or reverse direction. The wheels may be turned at different speeds, and it is possible to turn only one wheel. In some embodiments, instrumentation may be provided on the trainer to determine the rotational speed of the flywheels and to calculate values such as wheelchair speed, cumulative distance, work or energy, calories burned, etc. In some embodiments, the instrumentation may be part of a virtual gaming system.

At step 294, the user completes the desired training regimen.

At step 295, the cam lift means is disengaged by pushing either of or both of the right lever and the left lever. As the chair retention plate 252 is lowered, the retention blocks drop below the wheelchair rear axle.

At step 296, the wheelchair may be moved away from device.

DETAILED DESCRIPTION OF EMBODIMENT

Trainer with Cam Lift Means

This embodiment describes some of the many variations on the basic cam lift means device.

Cam Means

In this example, the cam lift means comprises a singe cam which is rotated with a right lever and a left lever. The right lever comprises an adjustable handle which can be moved toward or away from the center of the device. The left lever comprises a similar adjustable handle.

The cam acts to lift or to lower a chair retention block support platform support member which raises and lowers the retention block support platform. The chair retention block support platform may have one or more concaved or inclined retention blocks to engage the wheelchair axle.

Flywheel Axle Extensions

In this embodiment, the right flywheel axle includes a right flywheel axle extension for mounting a supplemental resistance device such as an additional flywheel resistance or a variable resistance device. The left flywheel axle comprises a similar extension.

Ratchet Drive Means

In one example, a ratchet drive means is provided for turning the flywheel resistance. The ratchet drive may be provided on the flywheel axle extensions, and the wheelchair is retained against fixed members rather than against the wheel engagement means. In this example, an aerobic exercise is provided through the ratchet motions rather than through rotating the wheelchair wheels.

DETAILED DESCRIPTION OF EMBODIMENT

Trainer with Hydraulic Lift Means

Another embodiment of the current invention is a trainer with a hydraulic lift means, such as a manual or electric hydraulic jack, to lift the rear wheels of a wheelchair. The wheels are then forced into contact with a wheel resistance means. The wheels are kept in place against the wheel resistance means with a wheelchair retention means. In one example, the wheel resistance means is a pair of flywheels, and the wheelchair retention means is at least one inclined block that engages the rear axle of a wheelchair.

Frame

In this embodiment, a frame provides support for the flywheels, for the hydraulic lift means, and for the chair retention means. In this example, the hydraulic lift means is a hydraulic jack. The frame includes a jack support. In this example, the frame also includes chair retention block support platform support members, which are raised and lowered by the jack, and which raise and lower retention block support platform.

Chair Retention Means

In this embodiment, the chair retention means comprises one or more inclined blocks supported on a platform. The platform is raised or lowered by the hydraulic lift means so that the block or blocks engage a portion of the rear wheelchair axle, lift the axle slightly, and force the axle backwards so that the rear wheels engage a wheel engagement means.

In this example, a pair of inclined blocks is provided on the retention block support platform. The pair of blocks includes a right retention block, and a left retention block. In one example, these blocks are fixed relative to the platform. In another example, the position of one or both blocks may be adjusted with a right block adjustment means, and a left block adjustment means. The inclined blocks may be constructed of a plastic, wood, or other material.

Hydraulic Lift Means

In this embodiment, the rear wheel axle 112 of the wheelchair is lifted by a hydraulic lift means. In one example, the hydraulic lift means is a manual jack. The jack may have a low lifting capacity because it is lifting only a portion of the total weight of a wheelchair and occupant. Since the front wheels typically stay on the ground and continue to bear weight as the rear wheels are raised, the jack need only lift about half of the total weight of the chair and the occupant. Since most commercially available jacks are rated for a much higher load, it typically takes multiple strokes of a jack lever to raise the platform to a desired height. In view of the low lift capacity requirement, a hydraulic jack could be provided that had a lower ration of stroke to lift in order to lift the rear wheels with fewer lever strokes.

In this example, the manual hydraulic jack may be raised by operating either a right lever or a left lever. The manual jack may be lowered by a lever mechanism.

In another example, the hydraulic lift means is an electric jack that can be operated by switch by the user. An electric jack may be powered from an electric outlet or by battery.

In this example, as the hydraulic lift means is raised, it acts on the right chair retention block support platform support member, and the left chair retention block support platform support member, thereby pivoting both chair retention block support platform support members and raising the chair retention block support platform.

In this example, when the chair retention block support platform is raised, the right retention block and the left retention block are raised and engage the rear axle 112 of the wheelchair.

When the hydraulic lift means is lowered, the right chair retention block support platform support member, and the left chair retention block support platform support member are allowed to lower by the weight upon them, thereby lowering the chair retention block support platform. In this example, when the chair retention block support platform is lowered, the right retention block and the left retention block are lowered and disengage the rear axle 112 of the wheelchair. As the chair retention block support platform is further lowered, the right retention block and the left retention block are lowered below the wheelchair axle so that the wheelchair may be driven away form the trainer device.

Methods

Figure 15:
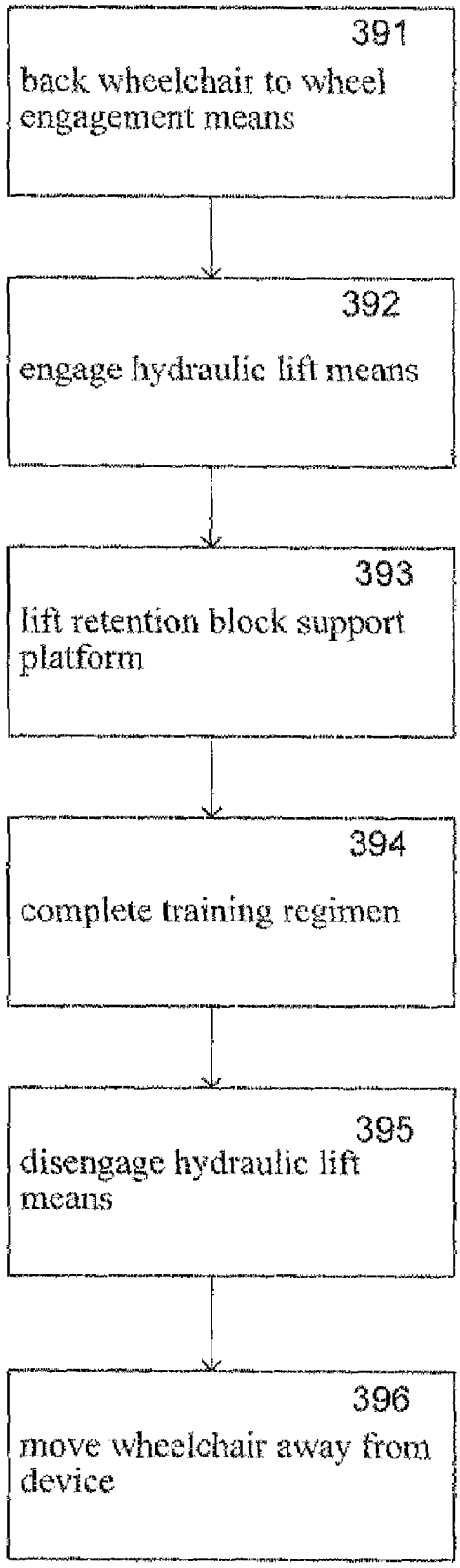
FIG. 15 is a flowchart for steps for using a trained with flywheel resistance and a hydraulic lift means.

FIG. 15 is a flowchart for steps for using a trained with flywheel resistance and a hydraulic lift means.

At step 391, the wheelchair is backed to the proximity of wheel engagement means. In this embodiment, the chair is backed so that the rear axle passes over the top of the right concave retention block and the left concave retention block. In this embodiment, each wheel engagement means has a length of about 6 inches (15.2 cm) so that there is a width tolerance for each wheel, and the wheelchair need not be exactly centered on the device.

At step 392, the hydraulic lift means is employed by ratcheting either of or both of the right lever 384*a* and the left lever 384*b*. As the retention block support platform is raised, the inclined retention blocks engage the wheelchair rear axle as described above. In this example, the retention block support platform is held in place until the manual jack pressure is released by the user.

At step 393, after the hydraulic lift means raises the retention block support platform to its desired position, the user is ready to use the trainer in an exercise mode as described above.

At step 394, the user completes the desired training regimen.

At step 395, the hydraulic lift means is disengaged by a lever mechanism (not shown). As the chair retention block support platform is lowered, the retention blocks drop below the wheelchair rear axle.

At step 396, the wheelchair may be moved away from device.

DETAILED DESCRIPTION OF EMBODIMENT

Trainer with Gear Lift Means

Another embodiment of the current invention is a trainer with a gear lift means to lift the rear wheels of a wheelchair. The wheels are then forced into contact with a wheel resistance means. The wheels are kept in place against the wheel resistance means with a wheelchair retention means. In one example, the wheel resistance means is a pair of flywheels, and the wheelchair retention means is at least one block that engages the rear axle of a wheelchair.

Frame

In this embodiment, the frame includes a gear support.

Gear Lift Means

In this example, the rear wheel axle 112 of the wheelchair is lifted by a gear lift means. A lever gear is attached to a lever axle. The lever axle is connected to a right lever, and to a left lever. The lever axle may be turned in a forward direction by pushing either the right lever or the left lever in a forward direction.

When the lever axle is rotated in the forward direction, the lever gear turns a platform gear. As the platform gear is turned, it raises the platform support member which raises the retention block support platform.

When the gear axle is rotated in the reverse direction, the lever gear turns the platform gear. As the platform gear is turned, it lowers the platform support member which lowers the retention block support platform.

Method of Operation

Figure 16:
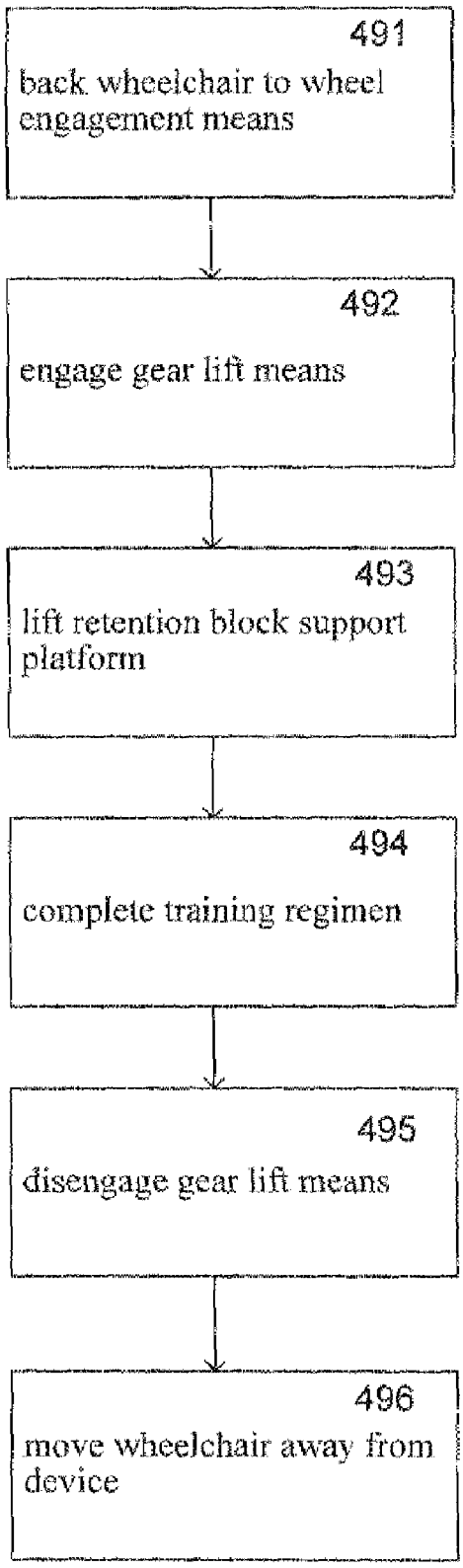
FIG. 16 is a flowchart for steps for using a trained with flywheel resistance and a gear lift means.

FIG. 16 is a flowchart for steps for using a trained with flywheel resistance and a gear lift means.

At step 491, the wheelchair is backed to the proximity of wheel engagement means 462*a*, 462*b*. In this embodiment, the chair is backed so that the rear axle passes over the top of the right concave retention block and the left concave retention block. In this embodiment, each wheel engagement means has a length of about 6 inches (15.2 cm) so that there is a width tolerance for each wheel, and the wheelchair need not be exactly centered on the device.

At step 492, the gear lift means is employed by pushing either of or both of the right lever and the left lever. In this example, the retention block platform may be a simple frame which is held in place by the weight of the chair on the mechanism, until released by the user.

At step 493, after the gear means raises the retention block support platform to its desired position, the user is ready to use the trainer in an exercise mode. At this point, the user may turn either or both rear wheels in either a forward or reverse direction. The wheels may be turned at different speeds, and it is possible to turn only one wheel. In some embodiments, instrumentation may be provided on the trainer to determine the rotational speed of the flywheels and to calculate values such as wheelchair speed, cumulative distance, work or energy, calories burned, etc. In some embodiments, the instrumentation may be part of a virtual gaming system.

At step 494, the user completes the desired training regimen.

At step 495, the gear lift means is disengaged by pushing either of or both of the right lever and the left lever. As the chair retention block support platform is lowered, the retention blocks drop below the wheelchair rear axle.

At step 496, the wheelchair may be moved away from device.

DETAILED DESCRIPTION OF EMBODIMENT

Exercise Techniques

The current invention supports a variety of exercise protocols. In one example, the device is operated in a "forward" direction which simulates forward movement of the wheelchair. In another example, the device is operated in a "reverse" direction which simulates a safe reverse movement of the wheelchair. In another example, the device is operated at different speeds for rear wheels. The ability to go backward can help to lengthen torso muscles which are contracted from the imbalance of operating a wheelchair primarily in a forward direction. Prior art trainers are typically effective in the forward direction. While the forward direction movement helps to strengthen muscles, it is not effective in lengthening the torso muscles, and the current invention offers a balanced exercise program. Also one wheel can be rotated forward with one arm while the other may be rotated in reverse to provide a "virtual turning" to allow both aerobic exercise, stretching, and the ability to "steer" in an electronic virtual environment, such as a driving, flying or skiing game.

DETAILED DESCRIPTION OF EMBODIMENT

Adaptor Axle for Collapsible Wheelchair

Some models of collapsible wheelchairs do not have a fixed rear axle. In this embodiment, the wheelchair is a collapsible chair comprising a frame with a seat, and supports for a right rear wheel and a left rear wheel. An adaptor axle is provided for attachment to the wheelchair frame so that the wheelchair retention means may engage the adaptor axle.

DETAILED DESCRIPTION OF EMBODIMENT

Separate Flywheel Axis

In this embodiment, each contact wheel of a wheelchair retention means has a first axis, and a second axis is provided for a flywheel. The first axis and the second axis may be linked with a sprocket and gear arrangement similar to a bicycle. For instance, a 6 inch contact wheel could turn a flywheel at a higher rotational speed, such as 3 times faster if geared appropriately. The faster rotation permits the use of a much smaller flywheel mass. Depending upon the inertial properties of the flywheel, a mass of only a few pounds is sufficient for the 200 pound system described above.

This arrangement also enables the user to increase or decrease the kinetic energy by adjusting the gear rather than actually changing the flywheel's physical mass or dimensions.

DETAILED DESCRIPTION OF EMBODIMENT

Instrumentation

In some embodiments a simple measurement of the rotational speed of the flywheels, in combination with the known resistance of device, can provide information about acceleration; torque and force; work and energy and caloric expenditure and power output; and equivalent translational speed and distance traveled. A sensor, such as a magnetic or optical such as those used commonly on bicycles and motors can be used to determine the rotational speed of the flywheels.

In some embodiments, physiological measurements may be combined with the speed measurements and force calculations, and the device can serve as a simple physiological study device.

In some devices, a variable resistance can be provided to establish a programmable resistance such as that provided in treadmills and exercise bicycles in order to provide a planned exercise routine.

DETAILED DESCRIPTION OF EMBODIMENT

Virtual Gaming System

In some embodiments the device measurements may be used in combination with computer gaming to provide a virtual reality environment or remote competition system.

What is claimed is:

1. A trainer for a wheelchair, the wheelchair comprising a frame comprising an axle or adaptor axle, a pair of front wheels, a first rear wheel, and a second rear wheel, the trainer comprising a trainer frame;

an independent flywheel resistance means comprising a first flywheel assembly comprising a first axle supported by the trainer frame, a first flywheel which provides a first resistance to the rotation of the first rear wheel, and a first roller rear wheel engagement means, and a second flywheel assembly comprising a second axle supported by the trainer frame, a second flywheel which provides a first resistance to the rotation of the second rear wheel, and a second roller rear wheel engagement means;

a vertical lift supported by the trainer frame, such that the vertical lift has a first lowered position where the first rear wheel is resting on the ground in proximity to the first roller, the second rear wheel is resting on the ground in proximity to the second roller, and the front wheels are resting on the ground, and a second raised position where the first rear wheel is lifted 1 to 3 inches off the ground to engage the first roller, the second rear wheel is lifted 1 to 3 inches off the ground to engage the second roller, the front wheels are resting on the ground, such that the wheelchair has an angle of inclination of less than 5 degrees; and a wheelchair retention means comprising an angularly adjustable retention plate that is pivotal between a disengaged position that allows entry of the wheelchair on the trainer frame and an engaged position wherein the retention plate directly engages the axle or adaptor axle and forces the first rear wheel and the second rear wheel into contact with the flywheel resistance means at an acute angle with respect to a horizontal plane.

2. The trainer of claim 1 wherein the flywheel resistance means further comprises at least one supplemental weight that may be attached to the first flywheel to increase the resistance of the first flywheel.

3. The trainer of claim 1 wherein the flywheel resistance means further comprises a first flywheel variable resistance means, such that the resistance for the first flywheel may be changed with the variable resistance means.

4. The trainer of claim 1 having a cam lift means and further comprising a pivotal wheelchair retention means support member, such that the pivotal wheelchair retention means support member pivots from a lowered position to a raised position;

a cam axle;

a cam affixed to a cam axle, such that the cam rotates in a first direction as the cam axle rotates in the first direction, and the cam rotates in a second direction as the cam axle rotates in the second direction, the cam contacts the pivotal wheelchair retention means support member so that as the cam rotates in the first direction it pivots the pivotal wheelchair retention means support member to the raised position, and as the cam rotates in the second direction it pivots the pivotal wheelchair retention means support member to the lowered position; and a lever affixed to the cam axle, so that as the lever is moved in the first direction, the cam axle and the cam rotate in the forward direction, and as the lever is moved in the second direction, the cam axle and the cam rotate in the reverse direction.

5. The trainer of claim 1 having a gear lift means and further comprising a pivotal wheelchair retention means support member, such that the pivotal wheelchair retention means support member pivots from a lowered position to a raised position;

a gear axle;

an axle gear affixed to a cam axle, such that the axle gear rotates in a forward direction as the gear axle rotates in the forward direction, and the axle gear rotates in a reverse direction as the gear axle rotates in the reverse direction;

a support gear which is turned by the axle gear, and which is connected to the pivotal wheelchair retention means support member such that as the support gear turns in the forward direction, the pivotal wheelchair retention means support member is raised to its raised position, and as the support gear turns in the reverse direction, the pivotal wheelchair retention means support member is lowered to its lowered position; and a lever affixed to the gear axle, so that as the lever is moved in a forward direction, the gear axle and the axle gear rotate in the forward direction, and as the lever is moved in a reverse direction, the gear axle and the axle gear rotate in the reverse direction.

6. The trainer of claim 1 further comprising a rotational speed sensor for determining the rotational speed of the flywheel resistance means.

7. The trainer of claim 1 wherein the wheelchair retention means engages the rear wheels of the wheelchair at a thrust angle in the range of 10 to 45 degrees.

8. The trainer of claim 1 further comprising a ratchet drive means.

9. A method of providing exercise to a wheelchair occupant, the wheelchair comprising a frame comprising an axle or adaptor axle, a pair of front wheels, a first rear wheel, and a second rear wheel, the method comprising providing a trainer comprising a trainer frame;

an independent flywheel resistance means comprising a first flywheel assembly comprising a first axle supported by the trainer frame, a first flywheel which provides a first resistance to the rotation of the first rear wheel, and a first roller rear wheel engagement means, and a second flywheel assembly comprising a second axle supported by the trainer frame, a second flywheel which provides a first resistance to the rotation of the second rear wheel, and a second roller rear wheel engagement means, a cam or gear or hydraulic wheelchair lift supported by the trainer frame, such that the lift includes a first lowered position where the first rear wheel is resting on the ground in proximity to the first roller, the second rear wheel is resting on the ground in proximity to the second roller, and the front wheels are resting on the ground, and a second raised position where the first rear wheel is lifted 1 to 3 inches off the ground to engage the first roller, the second rear wheel is lifted 1 to 3 inches off the ground to engage the second roller, the front wheels are resting on the ground, such that the wheelchair has an angle of inclination of less than 5 degrees; and a wheelchair retention means comprising an angularly adjustable retention plate that is pivotal between a disengaged position that allows entry of the wheelchair on the trainer frame and an engaged position wherein the retention plate directly engages the axle or adaptor axle and forces the first rear wheel and the second rear wheel into contact with the flywheel resistance means;

backing the wheelchair so that the first rear wheel and the second rear wheel are in proximity to the flywheel resistance means;

raising the first rear wheel and the second rear wheel to a height of less than three inches with the wheelchair lift without substantially moving the pair of front wheels;

forcing the first rear wheel and the second rear wheel into the flywheel resistance means, at an acute angle with respect to a horizontal plane, with the wheelchair retention means;

rotating at least one of the first rear wheel and the second rear wheel for a desired period of time;

lowering the first rear wheel and the second rear wheel with the wheelchair lift; and moving the wheelchair away from the trainer.

10. The method of claim 9 further comprising determining rotational speed of flywheel resistance means; and calculating the force required to turn the flywheel resistance means at the rotational speed.

11. The method of claim 9 further comprising adjusting a thrust angle to a desired setting within the range of 10 to 45 degrees.

12. The method of claim 9 further comprising raising the first rear wheel and the second rear wheel with the wheelchair lift to a height in the range of ½ to 3 inches.

* * * * *